US008581835B2

(12) United States Patent
Ozawa

(10) Patent No.: US 8,581,835 B2
(45) Date of Patent: Nov. 12, 2013

(54) ELECTRO-OPTICAL DEVICE, METHOD FOR DRIVING ELECTRO-OPTICAL DEVICE, CONTROL CIRCUIT AND ELECTRONIC APPARATUS

(75) Inventor: Tokuro Ozawa, Suwa (JP)

(73) Assignee: Seiko Epson Corporation (JP)

( * ) Notice: Subject to any disclaimer, the term of this patent is extended or adjusted under 35 U.S.C. 154(b) by 348 days.

(21) Appl. No.: 13/115,544

(22) Filed: May 25, 2011

(65) Prior Publication Data

US 2011/0292092 A1 Dec. 1, 2011

(30) Foreign Application Priority Data

May 26, 2010 (JP) ..... 2010-120196

(51) Int. Cl.
*G09G 3/34* (2006.01)

(52) U.S. Cl.
USPC ..... 345/107; 345/78; 345/690

(58) Field of Classification Search
None
See application file for complete search history.

(56) References Cited

U.S. PATENT DOCUMENTS

| | | | | |
|---|---|---|---|---|
| 6,229,506 | B1 * | 5/2001 | Dawson et al. | 345/82 |
| 6,876,345 | B2 | 4/2005 | Akimoto et al. | |
| 7,649,515 | B2 * | 1/2010 | Ozawa et al. | 345/82 |
| 2004/0252089 | A1 * | 12/2004 | Ono et al. | 345/82 |

FOREIGN PATENT DOCUMENTS

| | | |
|---|---|---|
| JP | 2005-309150 | 11/2005 |
| JP | 2008-033347 | 2/2008 |
| JP | 2009-048202 | 3/2009 |

OTHER PUBLICATIONS

Hwang, Young-In et al., "New Simple Pixel Circuits for Threshold Voltage and IR-Drop Compensation for AMOLED Displays", OLED R&D Center, Samsung Mobile Display Co., Ltd., pp. 635-638 (2010).

* cited by examiner

*Primary Examiner* — Adam R Giesy
(74) *Attorney, Agent, or Firm* — Harness, Dickey & Pierce, P.L.C.

(57) ABSTRACT

An electro-optical device includes a pixel circuit, and a driving circuit. The pixel circuit includes a driving transistor, a first capacitive element, an electro-optical element, and a switch. The driving circuit controls the switch to be turned off, varies a potential such that the driving transistor is turned on, during a first period, sets a potential at a control terminal to a compensation initial value by controlling the switch to be turned on, during a second period, supplies a grayscale potential corresponding to a designated grayscale, varies a driving potential such that the driving transistor is turned on, during a third period, and varies a voltage between the control terminal and a first terminal with the passage of time, during a fourth period.

20 Claims, 19 Drawing Sheets

<RESET PERIOD TRST (RESET OPERATION)>

<RESET PERIOD TRST FINISHED>

<COMPENSATION PREPARING PERIOD QA (WRITING OPERATION)>

⟨COMPENSATION PREPARING PERIOD QA (SET COMPENSATION INITIAL VALUE VINI)⟩

<COMPENSATION PERFORMING PERIOD QB (COMPENSATION OPERATION)>

<COMPENSATION PERFORMING PERIOD QB FINISHED>

<DRIVING PERIOD TDRV (DRIVING OPERATION)>

CONFIGURATION A
[OFF → ON]

CONFIGURATION B
[ON → OFF]

ELECTRO-OPTICAL DEVICE, METHOD FOR DRIVING ELECTRO-OPTICAL DEVICE, CONTROL CIRCUIT AND ELECTRONIC APPARATUS

CROSS-REFERENCE TO RELATED APPLICATION

This application is based on and claims priority from Japanese Patent Application No. 2010-120196, filed on May 26, 2010, the contents of which are incorporated herein by reference.

BACKGROUND

1. Technical Field

The present invention relates to a technique for compensating for an error in characteristics (particularly, a threshold voltage) of transistors in a pixel circuit.

2. Related Art

JP-A-2009-48202 discloses a technique for compensating for an error in characteristics (a threshold voltage or a mobility) of a driving transistor used to drive an organic EL element. FIG. 26 is a circuit diagram of a pixel circuit 90 disclosed in JP-A-2009-48202 (FIG. 11). During a writing period when a grayscale potential corresponding to a designated grayscale is supplied to an electrode 93 of a capacitive element 92 via a switch 91, a gate and a drain of a driving transistor 94 are connected (diode-connected) to each other through a switch 95 in a state where the driving transistor 94 is maintained to be turned on. Therefore, a gate-source voltage of the driving transistor 94 is set to a voltage Vrst which compensates for an error in the threshold voltage VTH thereof. In addition, during a driving period after the writing period has elapsed, a driving potential with a triangular waveform is supplied to the electrode 93 of each pixel circuit 90, and thereby a light emitting time of a light emitting element 97 connected to a circuit point 96 is controlled to be varied according to the designated grayscale.

However, it is difficult to apply the technique disclosed in JP-A-2009-48202 to a configuration in which a high resistance electro-optical element such as an electrophoresis element or a liquid crystal element is connected to the circuit point 96. This is because since a current hardly flows through the electro-optical element, a potential at the circuit point 96 is not determined, and thus the gate-source voltage of the driving transistor 94 does not converge to the target voltage Vrst even if the driving transistor 94 and the switch 95 are controlled to be in a turned-on state during the writing period.

SUMMARY

An advantage of some aspects of the invention is to effectively compensate for errors in characteristics of a driving transistor.

According to an aspect of the invention, there is provided an electro-optical device which includes a pixel circuit; and a driving circuit. The pixel circuit includes a driving transistor that has a first terminal connected to a driving potential line to which a driving potential is supplied, a second terminal connected to a circuit point, and a control terminal controlling a connection state between both the first and second terminals; a first capacitive element that has a first electrode connected to a signal line and a second electrode connected to the control terminal; an electro-optical element that is connected to the circuit point; and a switch that controls a connection between the circuit point and the control terminal. The driving circuit controls the switch to be turned off, and varies a potential at the control terminal such that the driving transistor is turned on, during a first period (for example, a reset period TRST) when the driving potential is set to a first potential (for example, a higher potential VDR_H); sets the potential at the control terminal to a compensation initial value by controlling the switch to be turned on, during a second period (for example, a compensation preparing period QA) after the first period has elapsed; supplies a grayscale potential corresponding to a designated grayscale from the signal line to the first electrode and varies the driving potential from the first potential to a second potential (for example, a lower potential VDR_L) such that the driving transistor is turned on, during a third period (for example, a compensation performing period QB) after the second period has elapsed; and varies a voltage between the control terminal and the first terminal with the passage of time, during a fourth period (for example, a driving period TDRV) after the third period has elapsed.

Based on the above-described configuration, during the first period, the first potential is supplied to the circuit point from the driving potential line via the first terminal and the second terminal of the driving transistor which is controlled to be turned on depending on the variation in the potential at the control terminal. During the second period, the potential at the control terminal is set to the compensation initial value by controlling the switch to be turned on. During the third period, since the driving transistor which has the diode connection via the switch is controlled to be turned on depending on the variation in the driving potential (the potential at the first terminal), charge in the control terminal is moved to the driving potential line via the switch, the circuit point, the second terminal, and the first terminal. Therefore, a voltage between the control terminal and the first terminal of the driving transistor approaches its threshold voltage (ideally, reaches its threshold voltage). In addition, during the fourth period, by varying the voltage between the control terminal and the first terminal with the passage of time, the driving transistor is changed from one of the turned-on state and the turned-off state to the other at a time point corresponding to a grayscale potential within the fourth period, and the application and the stopping of the voltage to the electro-optical element are controlled to be changed.

In the above-described configuration, the potential at the circuit point is fixed to the first potential during the first period, and thus if the first potential is appropriately set, it is possible to reliably enable a current to flow through the driving transistor during the third period. Therefore, it is possible to effectively compensate for errors in characteristics of the driving transistor by the compensation operation during the third period even in a state where the high resistance driven element is connected to the circuit point. In addition, the electro-optical element is a driven element which converts one of an electrical operation (an application of an electric field or a supply of a current) and an optical operation (variation in a grayscale or luminance) into the other. For example, a high resistance driven element such as an electrophoresis element or a liquid crystal element is suitably used as the electro-optical element of the invention.

Further, during the second period, a method for setting the potential at the control terminal to the compensation initial value is arbitrary. For example, a driving circuit in the aspect of the invention may vary the potential at the control terminal so as to be reverse to the variation during the first period before the second period starts, and set the potential at the control terminal to the compensation initial value by controlling the switch to be turned on during the second period. In the aspect of the invention, if the potential at the control terminal is varied so as to be reverse to the variation during the first period before the second period starts, and the circuit point is connected to the control terminal via the switch during the second period, the compensation initial value is set to a capacitive component accompanied by the circuit point through the movement of charge accumulated during the first period to the control terminal. Therefore, it is possible to set a compensation initial value (for example, if the driving transistor is of an N channel type, the compensation initial value is set to a high potential) such that the driving transistor is easily changed to the turned-on state during the third period.

On the other hand, a driving circuit in the aspect of the invention may control the switch to be turned on and then set the potential at the control terminal to the compensation initial value by varying the potential at the control terminal so as to be reverse to the variation during the first period, during the second period. In the aspect of the invention, the switch is controlled to be turned off, and thus the circuit point is disconnected from the control terminal during the first period, whereas the switch is controlled to be turned on, and thus the circuit point is connected to the control terminal during the second period. Therefore, the varying amount of the potential at the control terminal during the second period is lower than the varying amount of the potential at the control terminal during the first period. By the use of the difference in the varying amount described above, it is possible to set a compensation initial value (for example, if the driving transistor is of an N channel type, the compensation initial value is set to a high potential) such that the driving transistor is easily changed to the turned-on state during the third period.

According to the configuration in which a compensation initial value is set such that the driving transistor is easily changed to the turned-on state during the third period like in the aspects of the invention exemplified above, there is an advantage in that an amplitude of the driving potential (a difference between the first potential and the second potential) required to change the driving transistor to the turned-on state during the third period is reduced. In addition, in order to sufficiently vary the potential at the control terminal when the switch is changed to the turned-on state, a configuration is particularly preferable in which an additional capacitive element which is independent from the electro-optical element is connected to the circuit point.

During the fourth period, a method for changing a voltage between the control terminal and the first terminal with the passage of time is arbitrary. For example, a driving circuit in the aspect of the invention (for example, a first embodiment) may vary the potential at the control terminal with the passage of time due to a capacitive coupling with the first capacitive element by varying a potential at the first electrode during the fourth period. Also, a pixel circuit in the aspect of the invention (for example, a third embodiment) may further include a second capacitive element that has a third electrode connected to a capacitance line to which a capacitance potential is supplied and a fourth electrode connected to the control terminal, and the driving circuit may vary the potential at the control terminal with the passage of time due to a capacitive coupling with the second capacitive element by varying the capacitance potential during the fourth period. According to the aspect of the invention, there is an advantage in that an amplitude of a potential for the signal line can be reduced as compared with the aspect of the invention. On the other hand, according to the aspect of the invention, there is an advantage in terms of not using the second capacitive element of the aspect of the invention. In addition, a driving circuit in the aspect of the invention (for example, a fourth embodiment) may vary a voltage between the control terminal and the first terminal with the passage of time by varying the driving potential for the driving potential line during the fourth period.

Further, a method for varying the potential at the control terminal during the first period is also arbitrary. For example, a driving circuit in the aspect of the invention (for example, the first embodiment) may vary the potential at the control terminal due to a capacitive coupling with the first capacitive element by varying a potential at the first electrode during the first period. In addition, the aspect of the invention (for example, the third embodiment) in which the driving circuit varies the potential at the control terminal due to a capacitive coupling with the second capacitive element by varying the capacitance potential during the first period, is appropriately employed by the above-described aspect of the invention. According to the aspect of the invention, there is an advantage in that an amplitude of a potential for the signal line can be reduced as compared with the aspect of the invention. On the other hand, according to the aspect of the invention, there is an advantage in terms of not using the second capacitive element of the aspect of the invention.

The electro-optical device related to the above-described respective aspects may employ the aspect of the invention in which the driving circuit varies a voltage between the control terminal and the first terminal with the passage of time such that the driving transistor is changed from a turned-off state to a turned-on state at a time point corresponding to a designated grayscale within the fourth period, and the aspect of the invention in which the driving circuit varies a voltage between the control terminal and the first terminal with the passage of time such that the driving transistor is changed from a turned-on state to a turned-off state at a time point corresponding to a designated grayscale within the fourth period. However, from the viewpoint of reducing time from the start point of the fourth period till a viewer can recognize the content of a displayed image, the aspect of the invention is particularly preferable in which a viewer can recognize the content of a displayed image from the start point of the fourth period.

In the preferable aspect of the invention, the driving circuit applies a voltage with an opposite polarity to the polarity of a case where the driving transistor is turned on during the fourth period, to the electro-optical element during the first period. In the above-described aspect, since a voltage (a reverse bias) with an opposite polarity to a voltage (a forward bias) applied in a case where the driving transistor is turned on during the fourth period is applied to the electro-optical element during the first period, an application of a DC component to the electro-optical element is reduced as compared with a configuration where a voltage is not applied to the electro-optical element during the first period. Therefore, it is possible to suppress deterioration in characteristics of the electro-optical element caused by the application of the DC component.

An electro-optical device related to an appropriate example of the aspect of the invention (for example, a fifth embodiment) may further include a display portion in which the pixel circuit is arranged in plurality in a planar shape, wherein a first unit period and a second unit period are set each of which includes the first period, the second period, the third period, and the fourth period, in a case where a display image on the display portion is changed from a first image including a first grayscale and a second grayscale to a second image. Here, the driving circuit supplies a grayscale potential according to the first grayscale to first pixel circuits corresponding to pixels of the first grayscale in the first image among the plurality of pixel circuits and supplies a grayscale potential according to the second grayscale to second pixel circuits corresponding to pixels of the second grayscale in the first image among the plurality of pixel circuits after the first period in the first unit period has elapsed, and supplies a grayscale potential corresponding to a grayscale for the second image to the respective pixel circuits after the first period in the second unit period has elapsed. In the above aspect, by applying reverse bias to both of the first pixel circuits and the second pixel circuits during the first period in the first unit period, and by supplying a grayscale potential for the second grayscale to the first pixel circuits after the first period in the first unit period has elapsed and supplying a grayscale potential for the first grayscale to the second pixel circuits, charge amounts accumulated in the electro-optical element (accumulated charge amount) in the first pixel circuits and the second pixel circuits become the same as each other. In addition, by applying the reverse bias during the first period in the second unit period, a charge amount in the electro-optical elements of both of the first and second pixel circuits is set to zero. Therefore, it is possible to effectively suppress the application of the DC component to the electro-optical element.

The electro-optical devices related to the above-described respective aspects may be mounted on various kinds of electronic apparatuses, for example, as display devices displaying images. The electro-optical device of the invention is appropriately applicable to electronic apparatuses such as a portable information terminal (for example, a portable phone or a wristwatch) and an electronic paper.

The invention is specified as a method for driving the electro-optical device related to the above-described respective aspects. Specifically, according to another aspect of the invention, there is provided a method for driving an electro-optical device which has a pixel circuit including a driving transistor that has a first terminal connected to a driving potential line to which a driving potential is supplied, a second terminal connected to a circuit point, and a control terminal controlling a connection state between both the first and second terminals; a first capacitive element that has a first electrode connected to a signal line and a second electrode connected to the control terminal; an electro-optical element that is connected to the circuit point; and a switch that controls a connection between the circuit point and the control terminal, the method including controlling the switch to be turned off, and varying a potential at the control terminal such that the driving transistor is turned on, during a first period when the driving potential is set to a first potential; setting the potential at the control terminal to a compensation initial value by controlling the switch to be turned on, during a second period after the first period has elapsed; supplying a grayscale potential corresponding to a designated grayscale from the signal line to the first electrode and varying the driving potential from the first potential to a second potential such that the driving transistor is turned on, during a third period after the second period has elapsed; and varying a voltage between the control terminal and the first terminal with the passage of time, during a fourth period after the third period has elapsed. The above-described driving method achieves the operation and the effect which are the same as in the electro-optical device related to the invention.

In addition, the invention is also specified as a control circuit (for example, a control circuit 12 in FIG. 1) used in the electro-optical device related to the above-described respective aspects. According to still another aspect of the invention, there is provided a control circuit used in an electro-optical device which includes a pixel circuit having a driving transistor that has a first terminal connected to a driving potential line to which a driving potential is supplied, a second terminal connected to a circuit point, and a control terminal controlling a connection state between both the first and second terminals; a first capacitive element that has a first electrode connected to a signal line and a second electrode connected to the control terminal; an electro-optical element that is connected to the circuit point; and a switch that controls a connection between the circuit point and the control terminal, and a driving circuit driving the pixel circuit, wherein the control circuit controls the driving circuit in order to control the switch to be turned off, and varies a potential at the control terminal such that the driving transistor is turned on, during a first period when the driving potential is set to a first potential; sets the potential at the control terminal to a compensation initial value by controlling the switch to be turned on, during a second period after the first period has elapsed; supplies a grayscale potential corresponding to a designated grayscale from the signal line to the first electrode and vary the driving potential from the first potential to a second potential such that the driving transistor is turned on, during a third period after the second period has elapsed; and varies a voltage between the control terminal and the first terminal with the passage of time, during a fourth period after the third period has elapsed. The above-described control circuit achieves the operation and the effect which are the same as in the electro-optical device related to the invention.

BRIEF DESCRIPTION OF THE DRAWINGS

The invention will be described with reference to the accompanying drawings, wherein like numbers reference like elements.

DESCRIPTION OF EXEMPLARY EMBODIMENTS

A: First Embodiment

Figure 1:
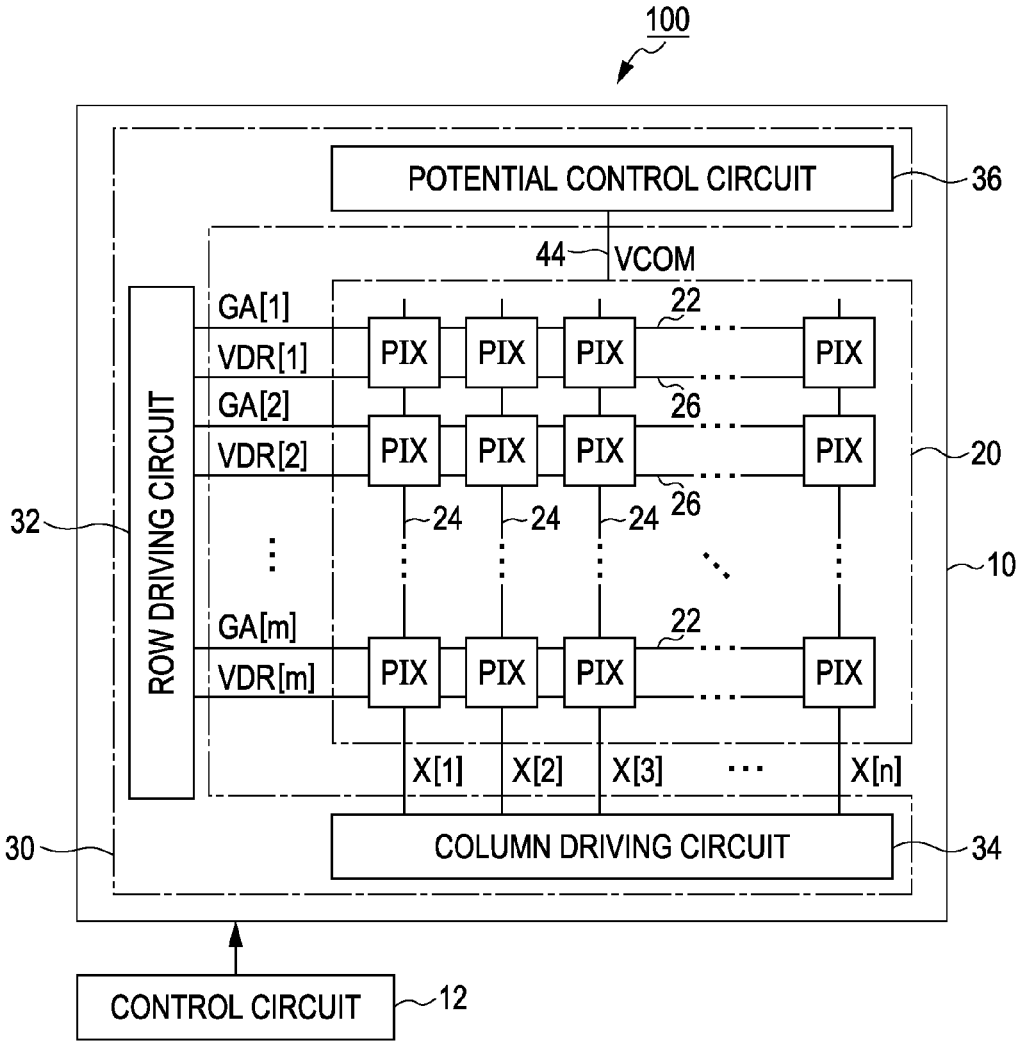
FIG. 1 is a block diagram of an electro-optical device related to a first embodiment.

FIG. 1 is a block diagram of an electro-optical device 100 according to a first embodiment. The electro-optical device 100 is an electrophoresis display device which displays images using electrophoresis of charged particles, and includes a display panel 10 and a control circuit 12 as shown in FIG. 1. The display panel 10 includes a display portion 20 where a plurality of pixel circuits PIX is arranged in a planar shape and driving circuits 30 driving each pixel circuit PIX. The control circuit 12 controls the display panel 10 (the driving circuits 30) such that the display portion 20 displays images.

The display portion 20 is provided with M control lines 22 and N signal lines 24 which intersect each other (where M and N are natural numbers). The plurality of pixel circuits PIX in the display portion 20 are disposed at the respective intersections of the control lines 22 and the signal lines 24 and arranged in a matrix of height M rows×width N column. In addition, the display portion 20 includes M driving potential lines 26 which are parallel to the respective control lines 22.

The driving circuits 30 drive the respective pixel circuit PIX under the control of the control circuit 12. As shown in FIG. 1, the driving circuits 30 include a row driving circuit 32, a column driving circuit 34, and a potential control circuit 36. The row driving circuit 32 supplies control signals GA[1] to GA[m] to the respective control lines 22 and supplies driving potentials VDR[1] to VDR[m] to the respective driving potential lines 26. The driving potentials VDR[1] to VDR[m] are respectively set to a higher potential VDR_H or a lower potential VDR_L (VDR_H>VDR_L). In addition, a configuration may be employed in which a circuit generating the control signals GA[1] to GA[m] and a circuit generating the driving potentials VDR[1] to VDR[m] are separately mounted. The column driving circuit 34 supplies instruction signals X[1] to X[n] to the respective signal lines 24.

The potential control circuit 36 generates and outputs a common potential VCOM which is commonly supplied to the respective pixel circuits PIX. The common potential VCOM is set to a higher potential VCOM_H or a lower potential VCOM_L (VCOM_H>VCOM_L). The higher potential VCOM_H of the common potential VCOM and the higher potential VDR_H of the driving potentials VDR[1] to VDR [m] have the same potential (for example, 15 V), and the lower potential VCOM_L of the common potential VCOM and the lower potential VDR_L of the driving potentials VDR [1] to VDR[m] have the same potential (for example, 0 V).

Figure 2:
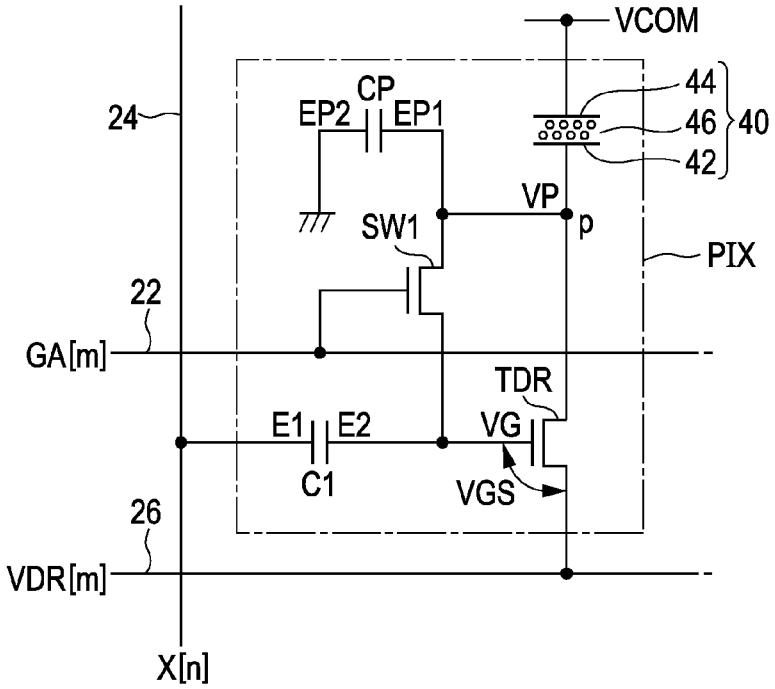
FIG. 2 is a circuit diagram of a pixel circuit according to the first embodiment.

FIG. 2 is a circuit diagram of each pixel circuit PIX. In FIG. 2, one pixel circuit PIX positioned at the m-th row (m=1 to M) and the n-th column (n=1 to N) as a representative. As shown in FIG. 2, the pixel circuit PIX is an electronic circuit corresponding to each pixel of a displayed image, and includes an electrophoresis element 40, a driving transistor TDR, a switch SW1, a capacitive element C1, and an additional capacitive element CP.

Figure 3:
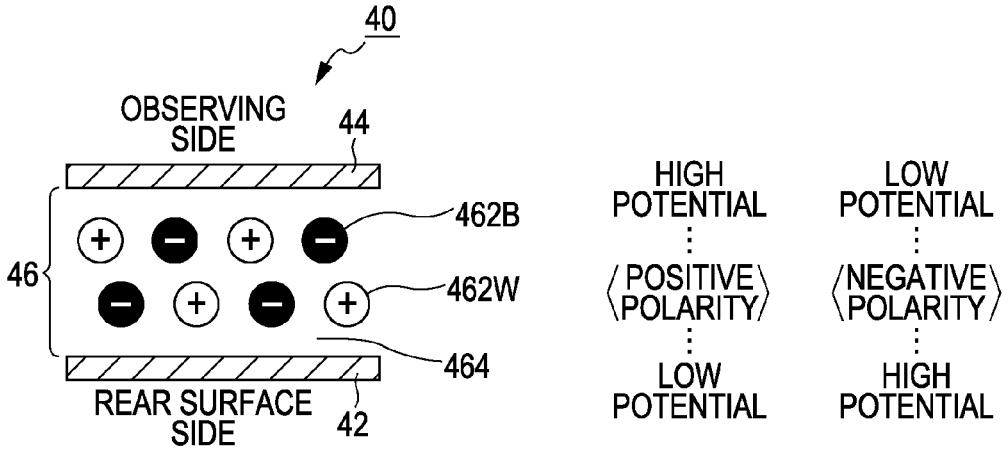
FIG. 3 is a schematic diagram of an electrophoresis element.

The electrophoresis element 40 is a high resistance electro-optical element which represents grayscales using electrophoresis of charged particles, and includes a pixel electrode 42 and an opposite electrode 44 which are opposite to each other, and an electrophoresis layer 46 between both the electrodes. As shown in FIG. 3, the electrophoresis layer 46 includes white and black charged particles 462 (462W and 462B) which are charged with opposite polarities to each other, and a dispersion medium 464 which is dispersed such that the charged particles 462 can be migrated. For example, a configuration is appropriately employed in which the charged particles 462 and the dispersion medium 464 are sealed in a microcapsule, or a configuration is appropriately employed in which the charged particles 462 and the dispersion medium 464 are sealed in a space divided by partitions.

The pixel electrode 42 is individually formed for each pixel circuit PIX, and the opposite electrode 44 is formed continuously over the plurality of pixel circuits PIX. As shown in FIG. 2, the pixel electrode 42 is connected to a circuit point (node) p in the pixel circuit PIX. The opposite electrode 44 is supplied with the common potential VCOM from the potential control circuit 36. In addition, a polarity of a voltage applied to the electrophoresis element 40 when the opposite electrode 44 has a higher potential than the pixel electrode 42 will be hereinafter denoted by "a positive polarity" for convenience. As shown in FIG. 3, a case where the opposite electrode 44 is positioned at an observing side (a side where a displayed image is output) with respect to the pixel electrode 42, the white charged particles 462W are charged with the positive polarity and the black charged particles 462B are charged with the negative polarity will be hereinafter exemplified for convenience. Therefore, the grayscale for the electrophoresis element 40 becomes black when a voltage with the positive polarity is applied, and becomes white when a voltage with the negative polarity is applied.

The driving transistor TDR in FIG. 2 is an N channel type thin film transistor driving the electrophoresis element 40, and is disposed on a path which connects the circuit point p (the pixel electrode 42) to driving potential line 26 in the m-th row. Specifically, a drain of the driving transistor TDR is connected to the circuit point p (the pixel electrode 42), and a source of the driving transistor TDR is connected to the driving potential line 26. In addition, in the first embodiment, since voltages at the drain and the source of the driving transistor TDR may have relatively reversed magnitudes, in a case where the drain and the source are differentiated from each other in terms of the relative magnitude, the drain and the source of the driving transistor TDR change between them at all times, and thus, for convenience of description, the terminal (first terminal) of the driving transistor TDR in the driving potential line 26 side is denoted by a source and the terminal (second terminal) in the pixel electrode 42 side is denoted by a drain.

The switch SW1 is constituted by an N channel thin film transistor in the same manner as the driving transistor TDR, and is connected between the gate of the driving transistor TDR and the circuit point p (between the gate and the drain of the driving transistor TDR) so as to control electrical connection between both the terminals (connection and disconnection). The gate of the switch SW1 is connected to the m-th row control line 22. If the switch SW1 is changed to be turned on, the gate and the drain of the driving transistor TDR are connected (diode-connected) to each other.

The capacitive element C1 is an electrostatic capacitor including an electrode E1 and an electrode E2. The electrode E1 is connected to the n-th column signal line 24, and the electrode E2 is connected to the gate of the driving transistor TDR. The additional capacitive element CP is an electrostatic capacitor including an electrode EP1 and an electrode EP2. The electrode EP1 is connected to the circuit point p, and the electrode EP2 is connected to the ground (GND). In addition, if the electrophoresis element 40 accompanies a sufficient capacitive component, the capacitive component of the electrophoresis element 40 may be used as the additional capacitive element CP.

Figure 4:
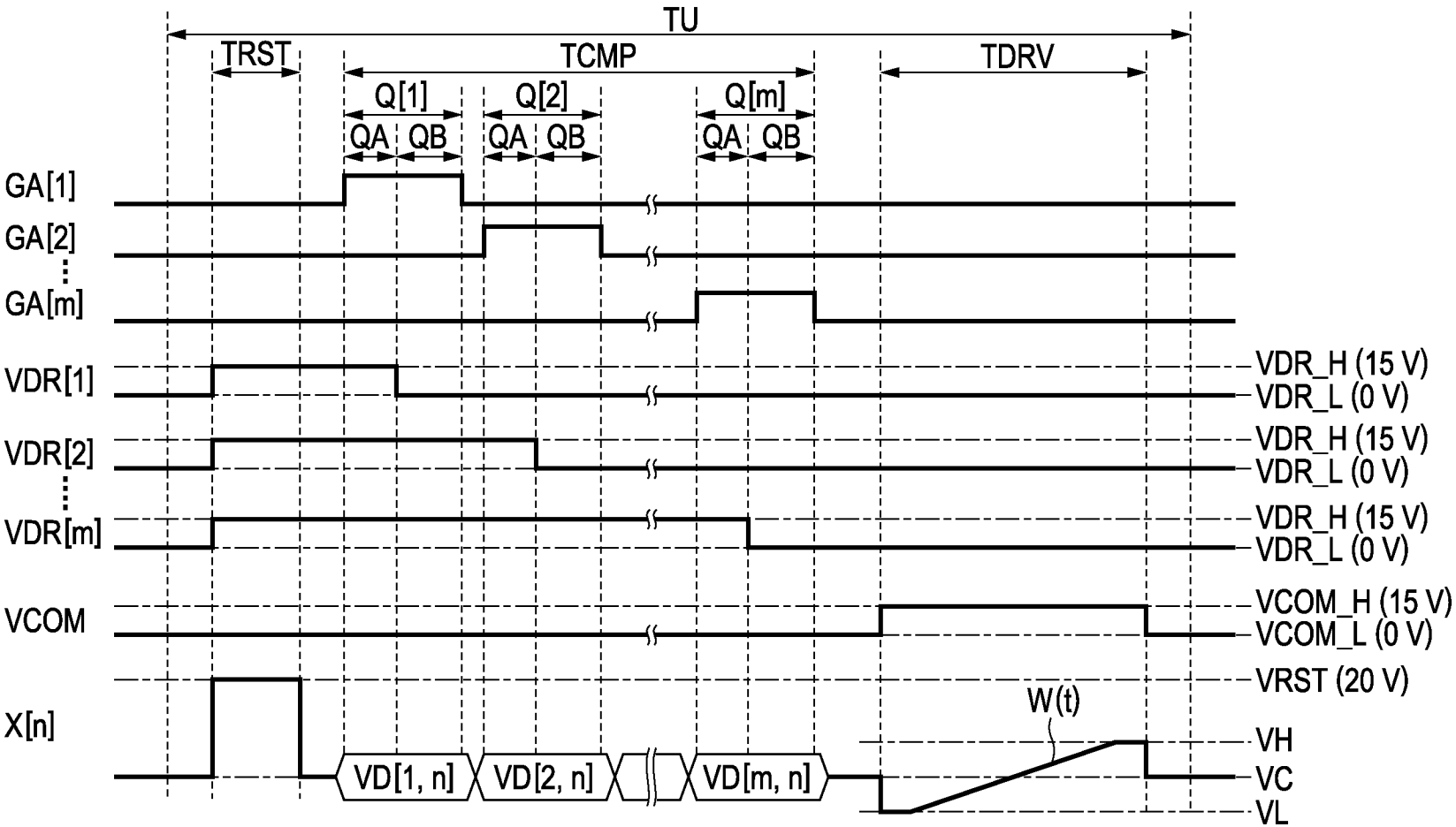
FIG. 4 is a diagram illustrating an operation according to the first embodiment.

FIG. 4 is a diagram illustrating an operation of the electro-optical device 100. As shown in FIG. 4, the electro-optical device 100 is sequentially operated with cycles of a unit period (frame) TU. The unit period TU in the first embodiment includes a reset period TRST as a "first period", a compensation period TCMP as a "second period" and a "third period", and a driving period TDRV as a "fourth period". During the reset period TRST, a reset operation for resetting a potential VP at the circuit point p (the pixel electrode 42) of each pixel circuit PIX is performed. The reset operation is performed in parallel (together) for all (M×N) the pixel circuits PIX in the display portion 20.

During the compensation period TCMP, a compensation operation in which the gate-source voltage VGS of the driving transistor TDR in each pixel circuit PIX is set to the threshold voltage VTH of the corresponding driving transistor TDR, and a writing operation in which a grayscale potential VD[m, n] corresponding to a grayscale designated to the pixel circuit PIX is supplied to each pixel circuit PIX are performed. The compensation period TCMP is divided into M selection periods Q[1] to Q[m] of corresponding to the pixel circuits PIX in the respective rows. During the m-th selection period Q[m] in the compensation period TCMP, the compensation operation and the writing operation are performed for N pixel circuits PIX in the m-th row.

During the driving period TDRV, the grayscale for the electrophoresis element 40 is controlled to be varied depending on the grayscale potential VD[m,n] which has been supplied to each pixel circuit PIX during the compensation period TCMP. Specifically, during the driving period TDRV, a driving operation (pulse width modulation) is performed in which the driving transistor TDR is turned on at a period of a time length corresponding to the grayscale potential VD[m, n], thereby controlling the grayscale for the electrophoresis element 40. The driving operation is performed in parallel (together) for all (M×N) the pixel circuits PIX in the display portion 20.

Figure 5:
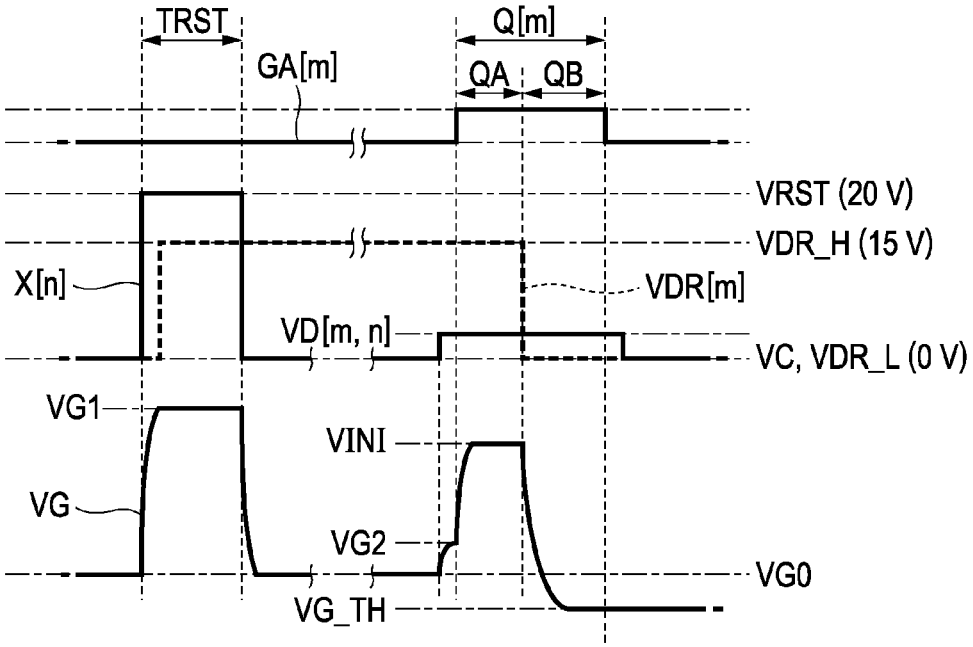
FIG. 5 is a diagram illustrating an operation during a reset period and a compensation period according to the first embodiment.

FIG. 5 is a diagram illustrating a potential VG at the gate of the driving transistor TDR in the pixel circuit PIX positioned at the m-th row and the n-th column. With reference to FIGS. 4 and 5, an operation at the respective periods (TRST, TCMP, and TDRV) which are schematically described above will be described. As shown in FIG. 5, it is assumed that immediately before the reset period TRST, the instruction signal X[n] supplied to the electrode E1 of the capacitive element C1 is set to a predetermined potential (hereinafter, referred to as a "reference potential") VC, and the potential VG at the gate of the driving transistor TDR is set to a potential VG0.

1. Reset Period TRST

Figure 6:
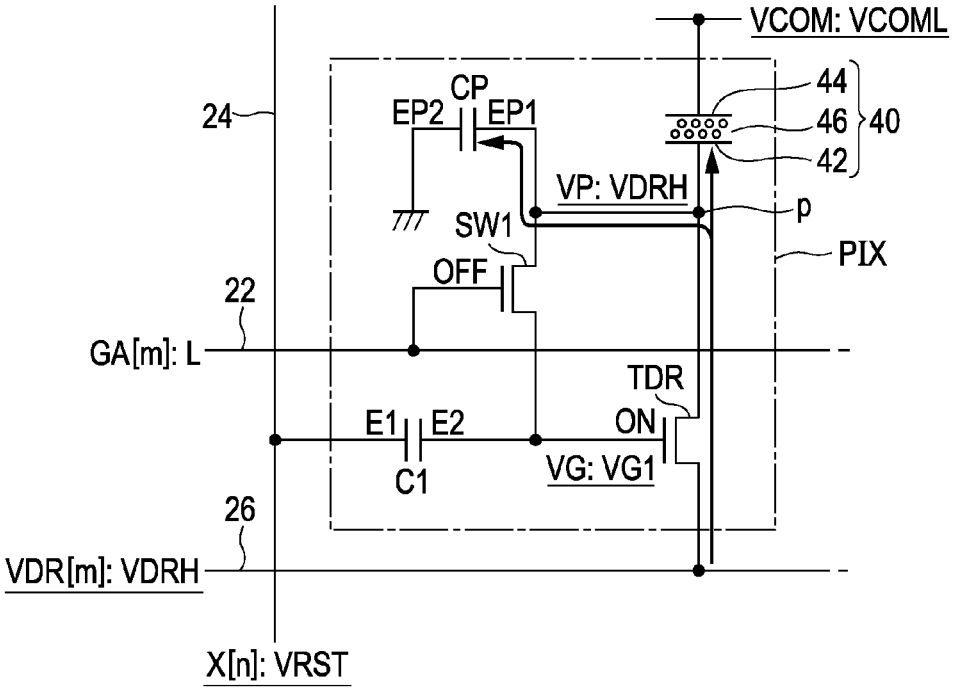
FIG. 6 is a diagram illustrating the pixel circuit during the reset period according to the first embodiment.

If the reset period TRST starts, the column driving circuit 34 changes potentials of the instruction signals X[1] to X[n] for the respective signal lines 24 from the reference potential VC to the reset potential VRST as shown in FIGS. 4 and 6. Since there is the capacitive element C1 between the signal line 24 and the gate of the driving transistor TDR, the potential VG at the gate of the driving transistor TDR is capacitively coupled to the capacitive element C1 and thus is changed along with the potential of the instruction signal X[n]. If the gate capacitance of the driving transistor TDR is ignored for convenience, the potential VG is changed from the potential VG0 immediately before the reset period TRST to the potential VG1 (VG1=VG0+(VRST−VC)) higher than the potential VG0 by the varying amount (VRST−VC) of the potential of the instruction signal X[n], as shown in FIG. 5. On the other hand, the row driving circuit 32 changes the driving potential VDR[1] to VDR[m] of the respective driving potential lines 26 from the lower potential VDR_L to the higher potential VDR_H. In addition, the control signal GA[m] is maintained to be in the low level, and thus the switch SW1 is maintained to be turned off during the reset period TRST.

The reset potential VRST of the instruction signal X[n] is set to maintain the turned-on state of the driving transistor TDR (VGS=VG1−VDR_H=VG0+(VRST−VC)−VDR_H>VTH) in a state where the driving potential VDR[m] (the potential at the source of the driving transistor TDR) is set to the higher potential VDR_H. As described above, since the driving transistor TDR enters the turned-on state during the reset period TRST, as marked with the arrow in FIG. 6, the higher potential VDR_H of the driving potential VDR[m] is supplied to the circuit point p (the pixel electrode 42) from the driving potential line 26 via the source and the drain of the driving transistor TDR. In other words, the potential VP at the circuit point p is reset to the higher potential VDR_H (reset operation).

During the reset period TRST, the potential control circuit 36 maintains the common potential VCOM at the opposite electrode 44 to be the lower potential VCOM_L. Therefore, a voltage with the negative polarity (hereinafter, referred to as a "reverse bias") corresponding to the difference (VDR_H−VCOM_L) between the higher potential VDR_H of the driving potential VDR[m] supplied to the pixel electrode 42 from the driving potential line 26 and the lower potential VCOM_L at the opposite electrode 44 is applied to the electrophoresis element 40. When the above-described reverse bias is applied, the grayscales for all the electrophoresis elements 40 in the display portion 20 are changed to the white side. In addition, charge according to the higher potential VDR_H of the driving potential VDR[m] is accumulated in the additional capacitive element CP of which the electrode EP1 is connected to the circuit point p. In other words, the additional capacitive element CP maintains the higher potential VDR_H.

Figure 7:
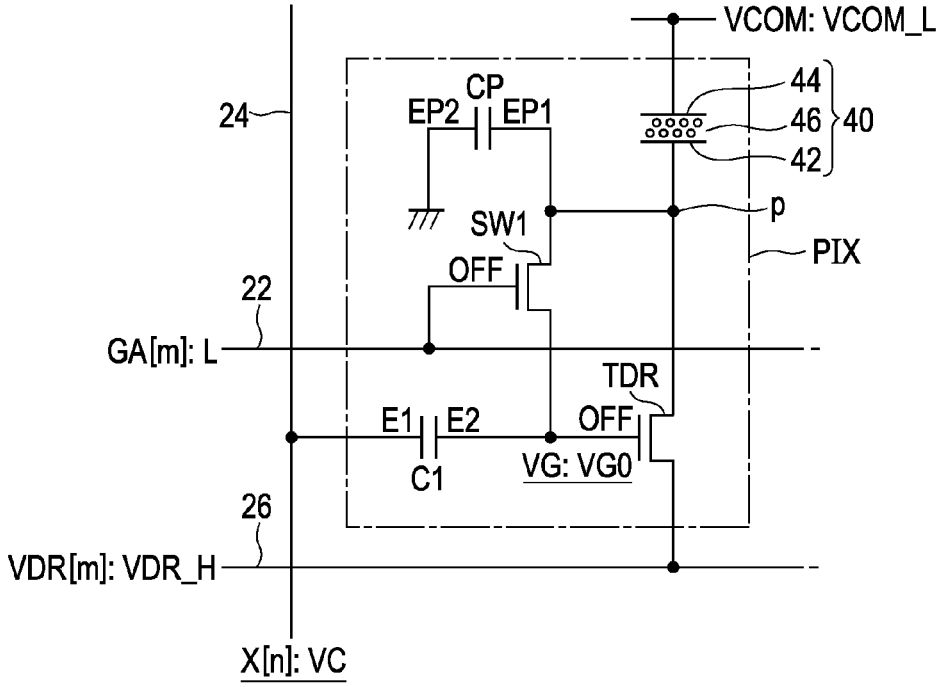
FIG. 7 is a diagram illustrating the pixel circuit when the reset period reaches the end point according to the first embodiment.

When the reset period TRST finishes, the column driving circuit 34 changes the instruction signals X[1] to X[n] for the respective signal lines 24 from the reset potential VRST to the reference potential VC as shown in FIGS. 4 and 7. The potential VG at the gate of the driving transistor TDR is decreased from the previous potential VG1 (VG1=VG0+(VRST−VC)) by the varying amount (VRST−VC) of the instruction signal X[n] and is set to the reference potential VG0 immediately before the reset period TRST. Therefore, when the reset period TRST finishes, the driving transistor TDR is turned off, and thus the higher potential VDR_H stops being supplied to the circuit point p. The driving potential VDR[m] is continuously maintained to be the higher potential VDR_H even after the reset period TRST finishes.

2. Compensation Period TCMP

As shown in FIG. 4, each selection period Q[m] in the compensation period TCMP is divided into the compensation preparing period QA as the "second period" and the compensation performing period QB as the "third period". During the compensation preparing period QA, the potential VG at the gate of the driving transistor TDR is set to a predetermined potential (hereinafter, referred to as a "compensation initial value") VINI, and, during the compensation performing period QB, the gate-source voltage VGS of the driving transistor TDR is set to the threshold voltage VTH thereof. The common potential VCOM at the opposite electrode 44 is also maintained to be the lower potential VCOM_L during the compensation period TCMP.

Figure 8:
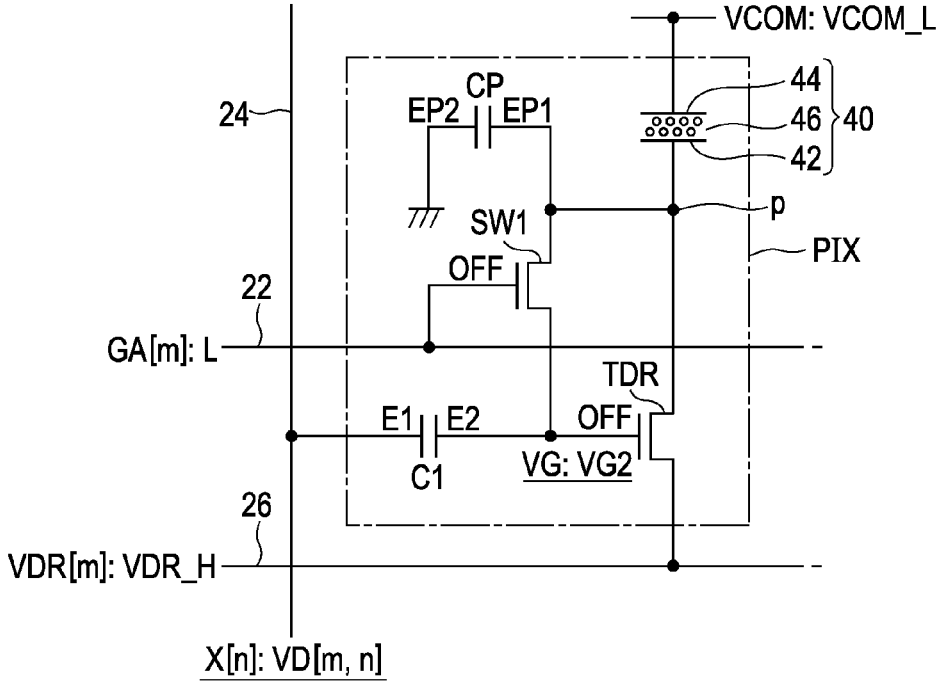
FIG. 8 is a diagram illustrating the pixel circuit during a compensation preparing period (during writing operation) according to the first embodiment.

During the compensation preparing period QA in the selection period Q[m], the column driving circuit 34 sets the instruction signal X[n] to the grayscale potential VD[m,n] (writing operation) as shown in FIGS. 4 and 8. The grayscale potential VD[m,n] is set to be changed depending on a grayscale designated to the pixel circuit PIX positioned at the m-th row and the n-th column. The potential VG at the gate of the driving transistor TDR is capacitively coupled to the capacitive element C1 and thus is varied along with the potential of the instruction signal X[n]. Specifically, the potential VG, as shown in FIG. 5, is changed to the potential VG2 (VG2=VG0+(VD[m,n]−VC) higher than the potential VG0 immediately after the reset period TRST by the varying amount (VD[m,n]−VC) of the potential of the instruction signal X[n].

Figure 9:
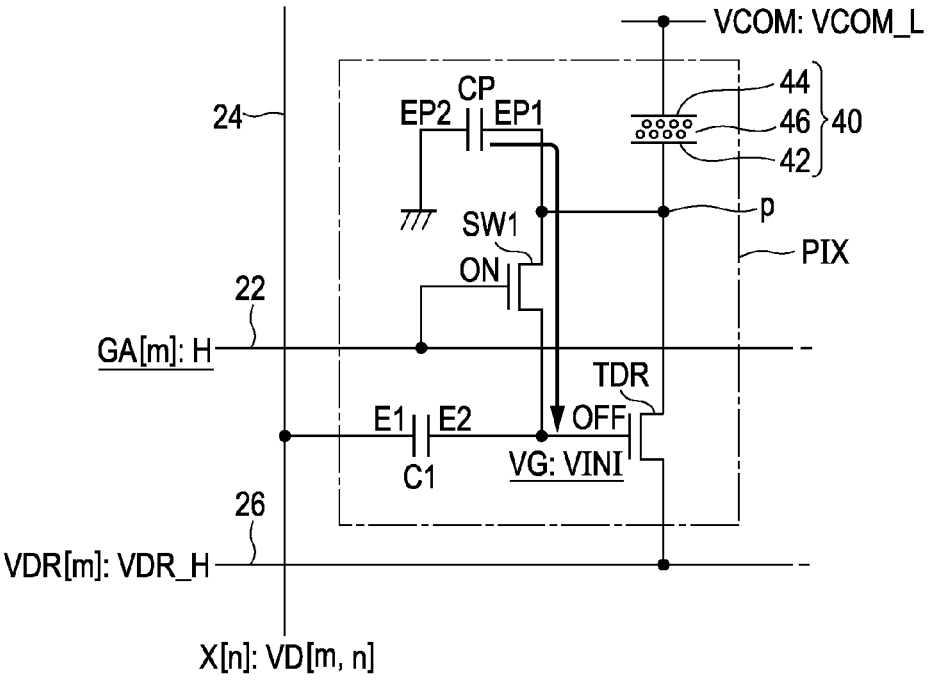
FIG. 9 is a diagram illustrating a pixel circuit during the compensation preparing period (at the time of setting a compensation initial value) according to the first embodiment.

The row driving circuit 32 controls the switch SW1 of each pixel circuit PIX in the m-th row to enter the turned-on state by setting the control signal GA[m] to the high level during the compensation preparing period QA as shown in FIGS. 4 and 9. If the switch SW1 is turned on, as shown in FIG. 9, the additional capacitive element CP is connected to the electrode E2 (the gate of the driving transistor TDR) of the capacitive element C1, and thus the charge accumulated in the capacitive element C1 is moved to the gate (the capacitive element C1) of the driving transistor TDR during the reset period TRST. Therefore, the potential VG at the gate of the driving transistor TDR is changed to the compensation initial value VINI larger than the previous potential VG2 (or the reference potential VC) as shown in FIG. 5. Specifically, the compensation initial value VINI is represented by the following equation (1) including a capacitance value c1 of the capacitive element C1 and a capacitance value cP of the additional capacitive element CP.

$$VINI=\alpha p\cdot VDR_H+(1-\alpha p)VG2 \quad (1)$$

$$(\alpha=cP/(cP+c1))$$

Figure 10:
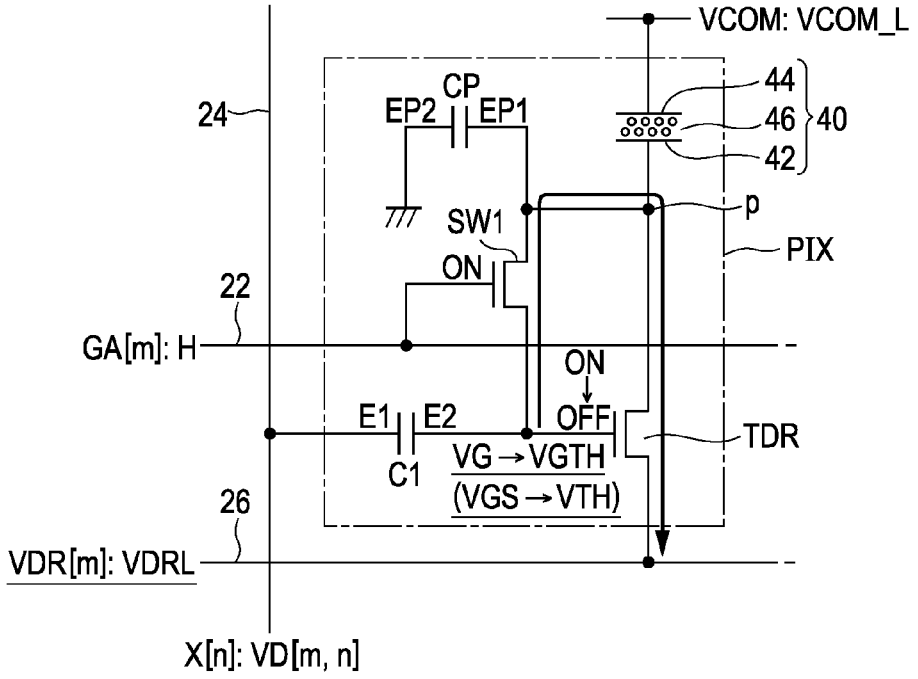
FIG. 10 is a diagram illustrating the pixel circuit during a compensation performing period according to the first embodiment.

During the compensation performing period QB in the selection period Q[m], similarly to the compensation preparing period QA, the instruction signal X[n] is maintained to be grayscale potential VD[m,n] and the switch SW1 is maintained to be in the turned-on state by the control signal GA[m] with the high level. In addition, when the compensation performing period QB starts, the row driving circuit 32, as shown in FIGS. 4 and 10, reduces the driving potential VDR[m] supplied to the source of the driving transistor TDR from the higher potential VDR_H to the lower potential VDR_L. The higher potential VDR_H and the lower potential VDR_L of the driving potential VDR[m] are set such that a difference between the compensation initial value VINI in the equation (1) and the lower potential VDR_L (that is, the gate-source voltage VGS of the driving transistor TDR) is larger than the threshold voltage VTH. Therefore, if the driving potential VDR[m] is decreased to the lower potential VDR_L at the start point of the compensation performing period QB, the driving transistor TDR is turned on. As can be seen from the equation (1), the compensation initial value VINI may be set to a high potential which can control the driving transistor TDR to be reliably in the turned-on state during the compensation performing period QB, by a degree that the capacitance value cP of the additional capacitive element CP is larger than the capacitance value c1 of the capacitive element C1 (that is, by the coefficient αp) or by a degree that the higher potential VDR_H supplied to the circuit point p during the reset period TRST is higher than the potential VG2.

Since the switch SW1 is also maintained to be turned on (the diode connection of the driving transistor TDR) during the compensation performing period QB, if the driving transistor TDR is turned on, as denoted by the arrow in FIG. 10, charge in the gate of the driving transistor TDR is moved to the driving potential line 26 via the switch SW1, the circuit point p, and the drain and the source of the driving transistor TDR. Therefore, as shown in FIG. 5, the potential VG at the gate of the driving transistor TDR is decreased from the compensation initial value VINI with the passage of time, and the driving transistor TDR is turned off when the gate-source voltage VGS reaches the threshold voltage VTH (compensation operation).

Figure 11:
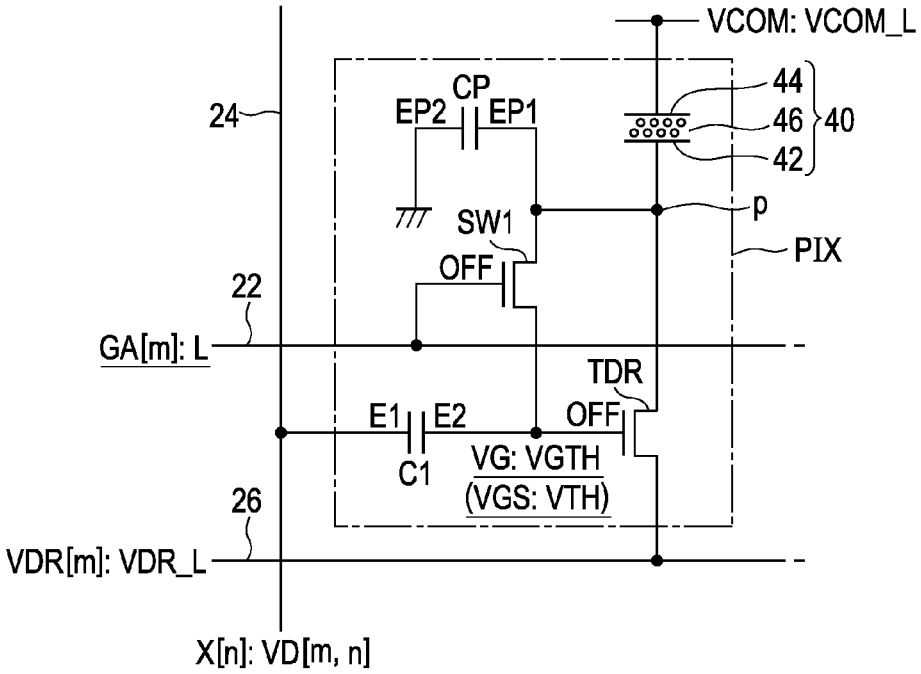
FIG. 11 is a diagram illustrating the pixel circuit when the compensation performing period reaches an end point according to the first embodiment.

If the compensation performing period QB in the selection period Q[m] is finished, the row driving circuit 32, as shown in FIGS. 4 and 11, controls the switch SW1 to be turned off of each of the pixel circuits PIX in the m-th row by changing the control signal GA[m] to the low level. In other words, the diode connection of the driving transistor TDR stops. As can be seen from the above description, at the end point of the compensation performing period QB, in the state where the grayscale potential VD[m,n] is supplied to the electrode E1 of the capacitive element C1, the potential VG at the gate of the driving transistor TDR is set to a potential VG_TH (a potential (VG_TH−VDR_L=VTH) where the gate-source voltage VGS of the driving transistor TDR reaches the threshold voltage VTH).

During the respective selection periods Q[1] to Q[m] in the compensation period TCMP, the above-described operation is performed sequentially. In addition, since the capacitive element C1 of each pixel circuit PIX is directly connected to the signal line 24, if the instruction signal X[n] is changed to the grayscale potential VD[m,n] during the selection period Q[m], potentials at the electrodes E1 of the capacitive elements C1 of the pixel circuits PIX in the respective rows excluding the m-th row are changed. In addition, when the potential at the electrode E1 is changed, the potential VG at the gate of the driving transistor TDR is changed, and thus the driving transistor TDR may be turned on in some cases. However, since the common potential VCOM at the opposite electrode 44 is maintained to be the lower potential VCOM_L during the compensation period TCMP, even if the driving transistor TDR is turned on, this has no influence on the grayscale for the electrophoresis element 40.

3. Driving Period TDRV

Figure 12:
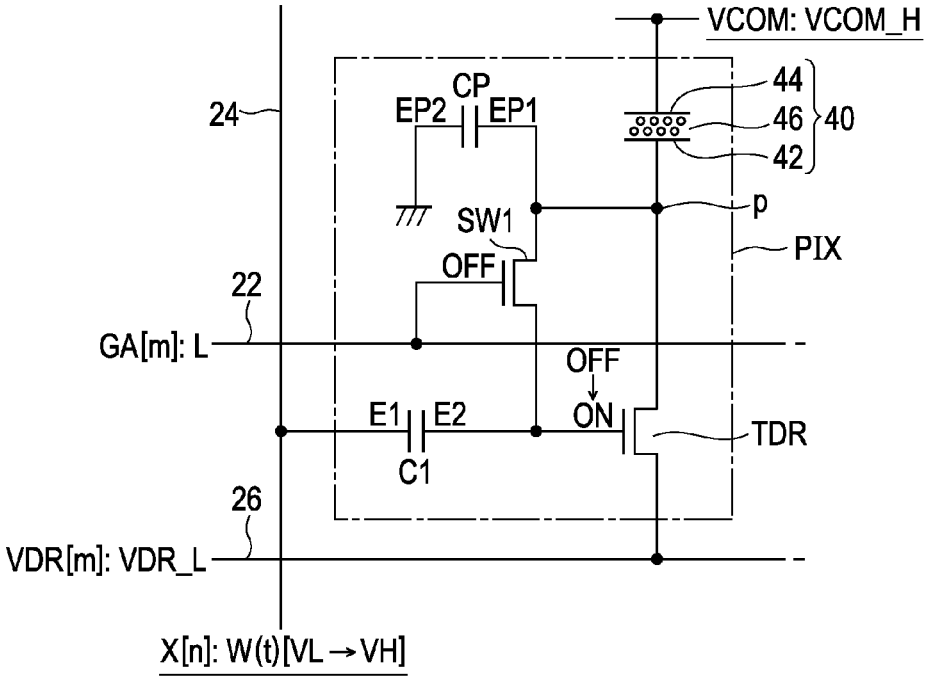
FIG. 12 is a diagram illustrating the pixel circuit during a driving period according to the first embodiment.

If the driving period TDRV starts after the compensation period TCMP has elapsed, as shown in FIGS. 4 and 12, the potential control circuit 36 sets the common potential VCOM at the opposite electrode 44 to the higher potential VCOM_H. On the other hand, the row driving circuit 32 continuously maintains the driving potentials VDR[1] to VDR[m] to be the lower potential VDR_L from the compensation performing period QB in each selection period Q[m].

On the other hand, the column driving circuit 34, as shown in FIGS. 4 and 12, sets the instruction signals X[1] to X[n] to a potential W(t) during the driving period TDRV. As shown in FIG. 4, the potential W(t) is changed between the potential VL and the potential VH (VH>VL) with the passage of time in order to include the reference potential VC in the variation range (for example, which has the reference potential VC as a central value). The potential W(t) in this embodiment is controlled to have a ramp waveform (sawtooth waveform) which is changed linearly from the potential VL to the potential VH from the start point of the driving period TDRV to the end point thereof. Therefore, in the driving transistor TDR of each pixel circuit PIX, in a state where the driving potential VDR [m] at the driving potential line 26 (the potential at the source) is maintained to be the lower potential VDR_L, the potential VG at the gate is changed (increased) along with the potential W(t) of the instruction signal X[n]. In other words, the gate-source voltage VGS of the driving transistor TDR is increased with the passage of time during the driving period TDRV.

During the compensation period TCMP, in the state where the grayscale potential VD[m,n] is supplied to the electrode E1 of the capacitive element C1, the potential VG (VG_TH) at the gate is set such that the gate-source voltage VGS of the driving transistor TDR becomes the threshold voltage VTH. Thus, during the driving period TDRV, at a time point when the potential W(t) of the instruction signal X[n] reaches the grayscale potential VD[m,n] for each pixel circuit PIX, as shown in FIG. 12, the gate-source voltage VGS of the driving transistor TDR of the corresponding pixel circuit PIX reaches the threshold voltage VTH thereof, and the driving transistor TDR is turned on. In other words, the driving transistor TDR of the pixel circuit PIX positioned at the m-th row and the n-th column is changed from the turned-off state to the turned-on state at a changing time point corresponding to the designated grayscale (the grayscale potential VD[m,n]) for the corresponding pixel circuit PIX during the driving period TDRV. As can be seen from the above description, the pixel circuit PIX functions as a comparison circuit which compares the grayscale potential VD[m,n] with the potential W(t).

Figure 13A:
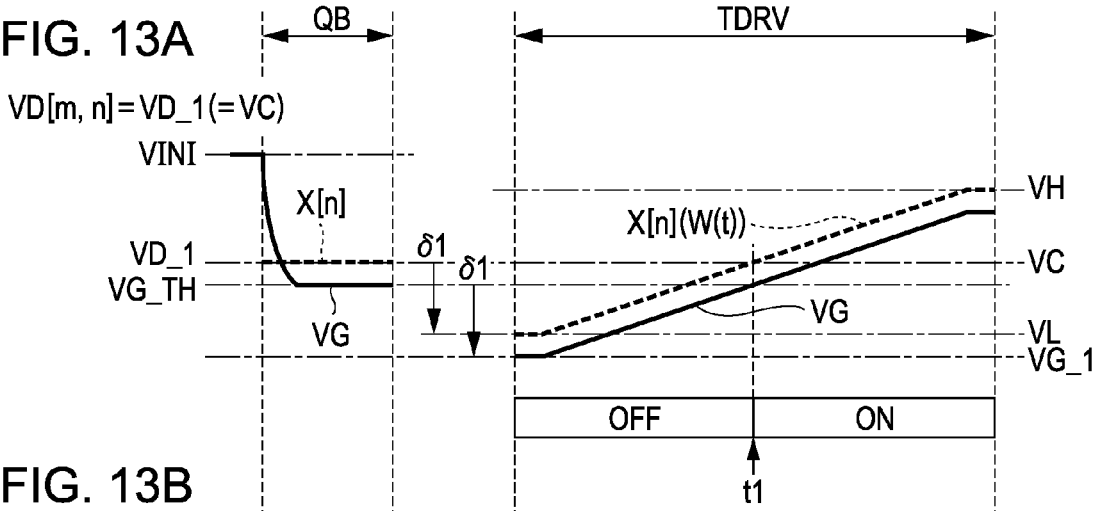
FIGS. 13A to 13C are diagrams illustrating a relationship between a driving point and a grayscale potential in the driving transistor according to the first embodiment.
Figure 13B:
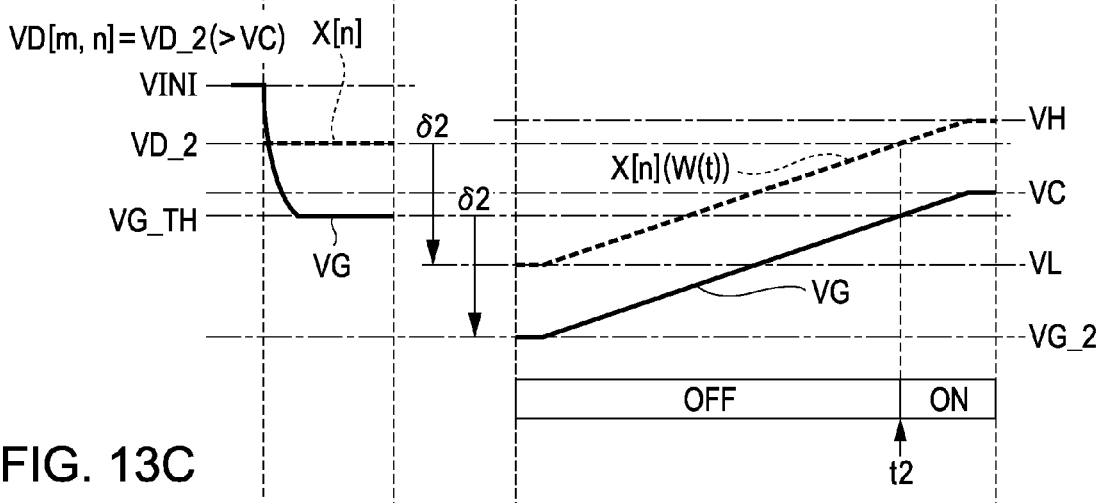
Figure 13C:
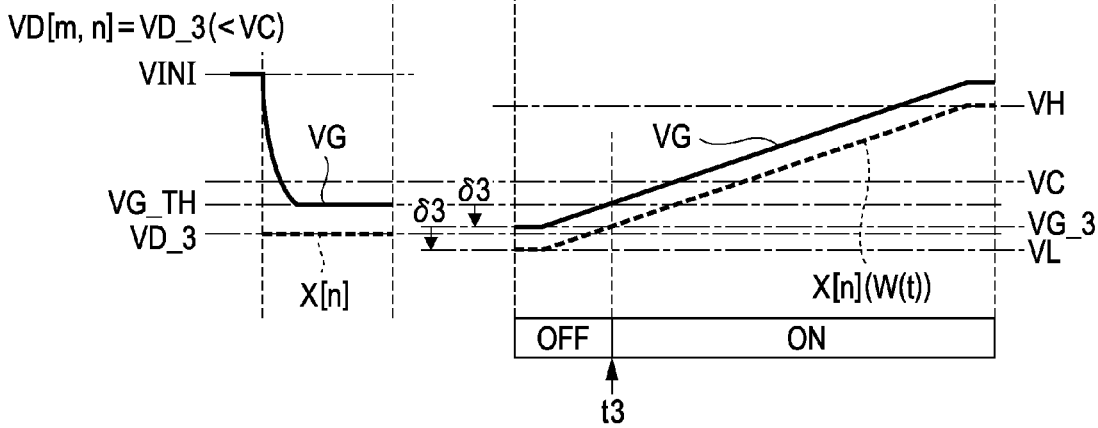

FIGS. 13A to 13C are schematic diagrams illustrating an example where time points (t1, t2 and t3) when the driving transistor TDR is changed from the turned-off state to the turned-on state is varied depending on the grayscale potential VD[m,n] during the driving period TDRV. The variation in the instruction signal X[n] is marked with broken lines, and the variation in the potential VG at the gate of the driving transistor TDR is marked with a solid line.

FIG. 13A shows a case where the grayscale potential VD[m,n] is set to a potential VD_1 during the compensation performing period QB in the selection period Q[m]. The potential VD_1 is the same potential as the reference potential VC corresponding to the amplitude center of the potential W(t). If the potential W(t) of the instruction signal X[n] is changed to the potential VL at the start point of the driving period TDRV, the potential VG at the gate of the driving transistor TDR is changed to the potential VG_1 which is lower than the potential VG_TH which has been set during the compensation period TCMP by the voltage difference 81 between the grayscale potential VD_1 and the potential VL. In addition, the potential VG is increased from the potential VG_1 along with the potential W(t) with the passage of time, and, at a time point t1 when it reaches the potential VG_TH (that is, a time point when the potential W(t) reaches the grayscale potential VD_1), the driving transistor TDR is changed from the turned-off state to the turned-on state.

FIG. 13B shows a case where the grayscale potential VD[m,n] is set to a potential VD_2 higher than the reference potential VC (VD_1) during the compensation performing period QB. The varying amount δ2 of the potential VG at the gate of the driving transistor TDR at the start point of the driving period TDRV is larger than the varying amount δ1 in FIG. 13A by the degree that the grayscale potential VD_2 is higher than the grayscale potential VD_1, and thus the potential VG_2 at the gate of the driving transistor TDR immediately after the driving period TDRV starts is lower than the potential VG_1 in FIG. 13A. Therefore, the driving transistor TDR is changed to the turned-on state at the time point t2 which is later than the time point t1 in FIG. 13A.

In addition, FIG. 13C shows a case where the grayscale potential VD[m,n] is set to a potential VD_3 lower than the reference potential VC (VD_1) during the compensation performing period QB. The varying amount δ3 of the potential VG at the gate of the driving transistor TDR at the start point of the driving period TDRV is smaller than the varying amount δ1 in FIG. 13A by the degree that the grayscale potential VD_3 is lower than the grayscale potential VD_1, and thus the potential VG_3 at the gate of the driving transistor TDR immediately after the driving period TDRV starts is higher than the potential VG_1 in FIG. 13A. Therefore, the driving transistor TDR is changed to the turned-on state at the time point t3 which is earlier than the time point t1 in FIG. 13A.

Figure 14:
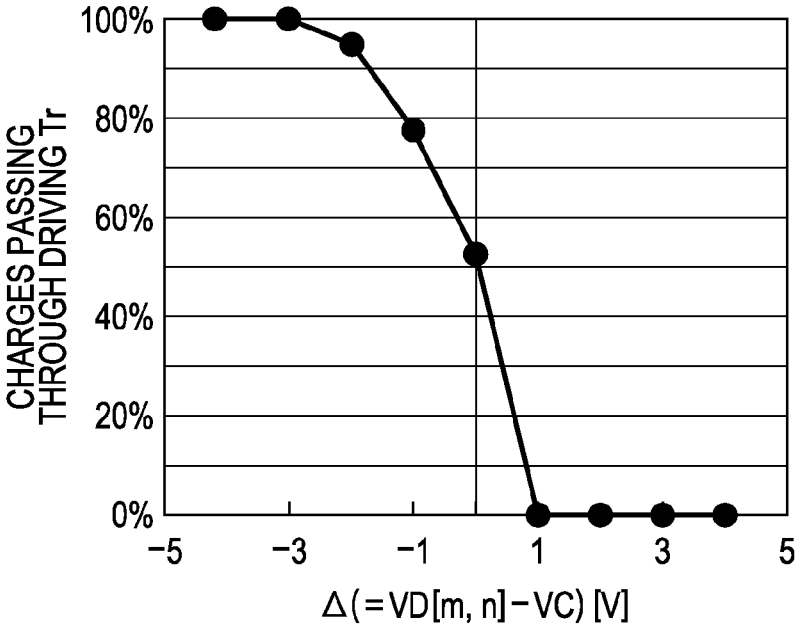
FIG. 14 is a graph illustrating a grayscale potential and an amount of charge passing through the driving transistor according to the first embodiment.

FIG. 14 is a graph illustrating a relationship (logic value) between a difference value Δ (Δ=VD[m,n]−VC) between the grayscale potential VD[m,n] and the reference potential VC, and a total amount of charge passing through the driving transistor TDR during the driving period TDRV (in other words, a ratio of time when the driving transistor TDR is turned on during the driving period TDRV). The numerical values on the longitudinal axis are normalized in terms of the maximum value of 100%. As can be seen from FIGS. 13A to 14, in the first embodiment, the higher the grayscale potential VD[m,n] is (the greater the difference value Δ with the reference potential VC is), the more the time when the driving transistor TDR is turned on (an amount of charge passing through the driving transistor TDR) is decreased during the driving period TDRV.

If the driving transistor TDR is turned on at the time point corresponding to the grayscale potential VD[m,n], since the lower potential VDR_L of the driving potential VDR[m] is supplied to the pixel electrode 42 from the driving potential line 26 via the driving transistor TDR, a voltage with the positive polarity (hereinafter, referred to as a "forward bias") corresponding to a difference between the lower potential VDR_L of the driving potential VDR[m] and the higher potential VCOM_H of the common potential VCOM is applied to the electrophoresis element 40. Therefore, the black charged particles 426B of the electrophoresis element 40 are moved to the observing side and the white charged particles 462W are moved to the rear surface side, and thus the display grayscale is changed to the black side. When the driving period TDRV finishes, the potential control circuit 36 changes the common potential VCOM to the lower potential VCOM_L (VCOM_L=VDR_L). Therefore, the application of voltages to the electrophoresis element 40 is finished.

As described above, since the forward bias is applied to the electrophoresis element 40 with the variable time length corresponding to the grayscale potential VD[m,n] (pulse width modulation), the grayscale for the electrophoresis element 40 of each pixel circuit PIX is controlled in multiple steps depending on the grayscale potential VD[m,n] for the corresponding pixel circuit PIX. Specifically, as the grayscale potential VD[m,n] is lowered (the time length when the driving transistor TDR is turned on during the driving period TDRV is increased), the grayscale for the electrophoresis element 40 is controlled to have a low grayscale (grayscale close to black). Thus, images with multi-grayscales including intermediate grayscales in addition to white and black are displayed on the display portion 20. In addition, the unit period TU is repeated at all times and thus the displayed images are changed.

In the above-described first embodiment, the driving transistor TDR is turned on during the reset period TRST, and thus the potential VP at the circuit point p is reset to the higher potential VDR_H. Thus, it is possible to reliably enable currents to flow between the drain (gate) and the source (that is, the compensation operation is performed) in the case where the driving transistor TDR has the diode connection during the compensation performing period QB. In other words, regardless of the configuration of employing the high resistance electro-optical element (the electrophoresis element 40), it is possible to effectively compensate for the error in the characteristic (the threshold voltage VTH) of the driving transistor TDR (furthermore, unevenness in the grayscales for the displayed image is suppressed). In addition, since the higher potential VDR_H is supplied to the circuit point p by turning on the driving transistor TDR, it is not necessary to mount an element only used to reset the potential VP (supply of the higher potential VDR_H) at the circuit point p on the pixel circuit PIX. Thereby, there is an advantage in that the configuration of the pixel circuit PIX is simplified.

In addition, in order to start the compensation operation at the compensation performing period QB, it is necessary to decrease the potential (the driving potential VDR[m]) at the source of the driving transistor TDR as compared with the potential VG at the gate such that the gate-source voltage VGS of the driving transistor TDR becomes greater than the threshold voltage VTH. In the first embodiment, since the potential VG (VG2) at the gate of the driving transistor TDR is increased to the compensation initial value VINI through the connection between the additional capacitive element CP and the capacitive element C1 during the compensation preparing period QA, if compared with a configuration (hereinafter, referred to as a "comparative example") in which the potential VG is not increased during the compensation preparing period QA, there is an advantage in that necessary conditions for the lower potential VDR_L of the driving potential VDR [m] are mitigated.

For example, if the threshold voltage VTH is assumed as 1 V, a case of a comparative example where the compensation operation starts in a state where the potential VG at the gate of the driving transistor TDR is set to the potential VG2 in FIG. 8 (that is, a configuration where the compensation preparing period QA in FIG. 9 is omitted) will be described. If the potential VG2 is −3 V, in order to realize the compensation operation based on the comparative example, the lower potential VDR_L of the driving potential VDR[m] is required to be set to −4 V. On the other hand, in the first embodiment, since the potential VG is increased to the compensation initial value VINI of, for example, 3 V, through the connection between the gate of the driving transistor TDR and the additional capacitive element CP during the compensation preparing period QA, the lower potential VDR_L of the driving potential VDR[m] is enough to be set to 2 V or less. That is to say, since conditions necessary for the lower potential VDR_L of the driving potential VDR[m] are mitigated, it is possible to set the respective potentials (VDR_H and VDR_L) of the driving potential VDR[m] to the same potentials as the respective potentials VCOM_H and VCOM_L of the common potential VCOM in the same manner as the first embodiment. As described above, the respective potentials are made to be common (the number of kinds of potentials is reduced), and thus there is an advantage in that configurations for generating the respective potentials are simplified. Further, since the driving transistor TDR has the diode connection during the compensation preparing period QA for the compensation operation during the compensation performing period QB, the potential VG is increased through the connection between the additional capacitive element CP and the capacitive element C1. In other words, the compensation initial value VINI is set along with the diode connection of the driving transistor TDR. Therefore, for example, as compared with a configuration in which an element only used to increase the potential VG before the compensation operation is particularly installed in the pixel circuit PIX, it is possible to simplify a configuration of the pixel circuit PIX.

Meanwhile, in a configuration in which a voltage with one polarity (DC component) is continuously applied to the electrophoresis element 40, the characteristics of the electrophoresis element 40 may be deteriorated. In the first embodiment, the application and the stopping of the forward bias to the electrophoresis element 40 are selectively performed during the driving period TDRV (that is, a voltage with the negative polarity is not applied to the electrophoresis element 40 during the driving period TDRV), and the reverse bias with a polarity reverse to the polarity of the voltage applied during the driving period TDRV is applied to the electrophoresis element 40 during the reset period TRST. Therefore, it is possible to suppress the deterioration in the electrophoresis element 40 due to the application of the DC component as compared with the configuration in which the reverse bias is not applied. Furthermore, since the higher potential VDR_H supplied to the circuit point p during the reset period TRST for the realization of the compensation operation is also used to apply the reverse bias to the electrophoresis element 40, there is an advantage in that a configuration of the pixel circuit PIX is simplified as compared with a configuration in which an element only used to apply the reverse bias is installed in the pixel circuit PIX.

B: Second Embodiment

Next, a second embodiment of this invention will be described. In addition, the elements having the same operations or functions as in the first embodiment in the respective aspects exemplified below are given the reference numerals described above, and the description thereof will be appropriately omitted.

In the first embodiment, the charge accumulated in the additional capacitive element CP during the reset period TRST are supplied to the gate of the driving transistor TDR during the compensation preparing period QA, and thus the potential VG is set to the compensation initial value VINI (the potential higher than the potential VG0). The second embodiment is different from the first embodiment in a method for setting (increasing) the potential VG at the gate of the driving transistor TDR to the compensation initial value VINI in the compensation preparing period QA. The configuration of the pixel circuit PIX is the same as in the first embodiment.

Figure 15:
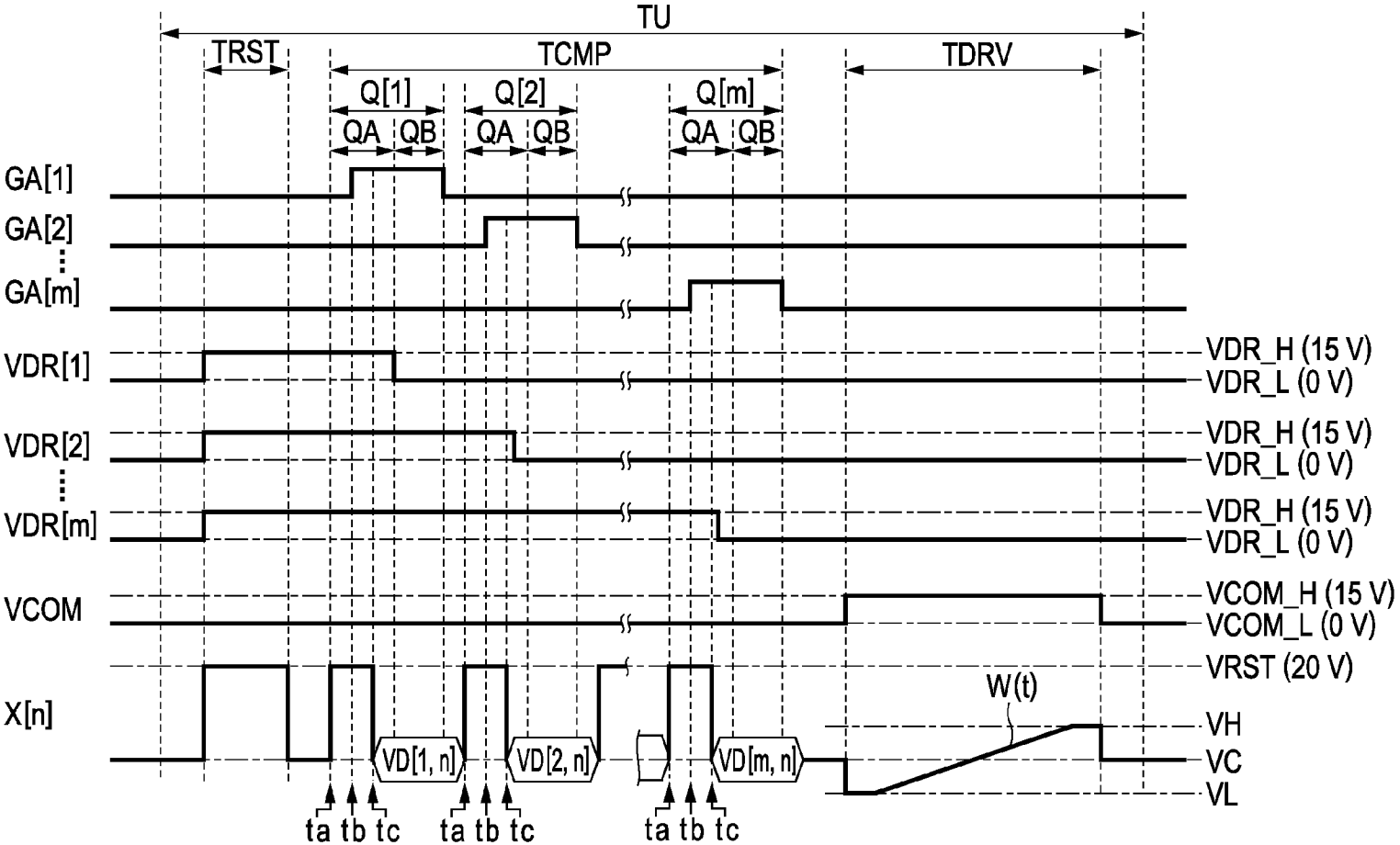
FIG. 15 is a diagram illustrating an operation according to a second embodiment.

FIG. 15 is a diagram illustrating an operation in the unit period TU according to the second embodiment. As can be seen from FIG. 15, the operations during the respective periods (the reset period TRST, the compensation performing period QB, the driving period TDRV) other than the compensation preparing period QA are the same as in the first embodiment. Therefore, only an operation during the compensation preparing period QA in the selection period Q[m] will be described.

Figure 16:
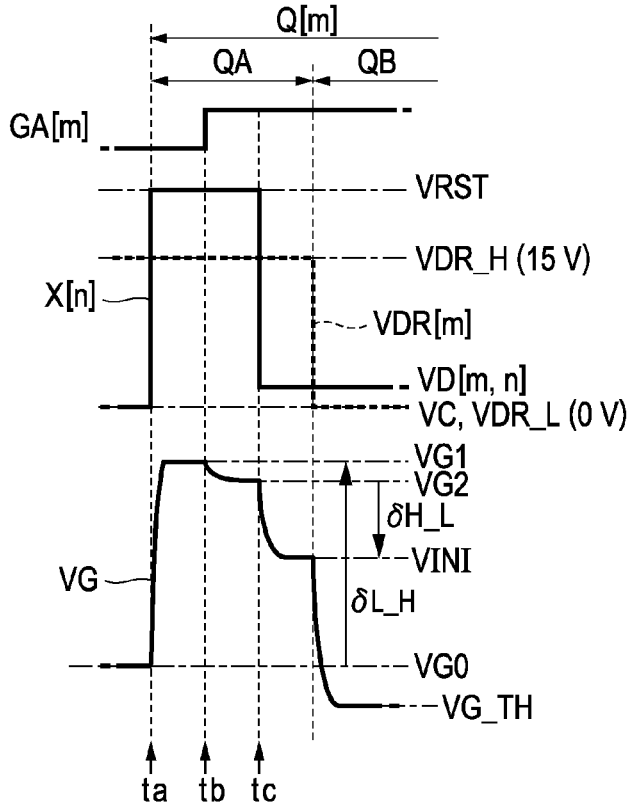
FIG. 16 is a diagram illustrating a potential at a gate of the driving transistor according to the second embodiment.

FIG. 16 is a diagram illustrating an operation during the selection period Q[m]. As shown in FIGS. 15 and 16, the column driving circuit 34 increases the instruction signal X[n] from the reference potential VC to the reset potential VRST at the start point ta of the compensation preparing period QA in the selection period Q[m]. The potential VG at the gate of the driving transistor TDR is increased from the potential VG0 to the potential VG1 according to the variation in the instruction signal X[n] at the start point ta. At the time point ta, the switch SW1 is maintained to be in the turned-on state by setting the control signal GA[m] to the low level. In other words, the additional capacitive element CP is electrically insulated from the gate (the capacitive element C1) of the driving transistor TDR. Therefore, an increasing amount δL_H (VG1=VG0+δL_H) of the potential VG is the same as a varying amount (VRST−VC) of a potential of the instruction signal X[n].

At the time point tb in the compensation preparing period QA, the row driving circuit 32 changes the control signal GA[m] to the high level such that the switch SW1 of each pixel circuit PIX in the m-th row is turned on. Therefore, the driving transistor TDR has the diode connection, and the additional capacitive element CP is connected to the gate of the driving transistor TDR. Since the potential VG at the gate is increased to the potential VG1 and thus the driving transistor TDR is turned on at the time point ta, if the potential VG at the gate of the driving transistor TDR is decreased with the passage of time from the time point tb and reaches the potential VG2 (VG2=VDR_H+VTH) in which the gate-source voltage VGS of the driving transistor TDR becomes the threshold voltage VTH, the driving transistor TDR is turned off.

If the time point tc comes after the time point tb, the column driving circuit 34 decreases the instruction signal X[n] from the reset potential VRST to the grayscale potential VD[m,n]. The potential VG at the gate of the driving transistor TDR is decreased from the potential VG2 to the compensation initial value VINI according to the variation in the potential of the instruction signal X[n]. At the time point tc, the additional capacitive element CP is connected to the gate of the driving transistor TDR via the turned-on switch SW1. Therefore, the decreasing amount δH_L (VINI=VG2−δH_L) of the potential VG immediately after the time point tc becomes a voltage (δH_L=α1(VRST−VD[m,n]), α1=c1/(c1+cP)) which is obtained by dividing the varying amount (VRST−VD[m,n]) of the potential of the instruction signal X[n] using the capacitance value c1 of the capacitive element C1 and the capacitance value cP of the additional capacitive element CP. In other words, the varying amount δH_L of the potential VG at the time point tc is lower than the varying amount δL_H of the potential VG at the time point ta. By the use of the difference between the varying amount δH_L and the varying amount δL_H, the compensation initial value VINI is set to the potential higher than the potential VG0 before the reset period TRST starts in the same manner as the first embodiment. During the compensation performing period QB after the compensation preparing period QA has elapsed, in the same manner as the first embodiment, the compensation operation is performed due to the change in the driving potential VDR [m] to the lower potential VDR_L.

The second embodiment also achieves the same effect as the first embodiment. In the second embodiment, since the difference between the varying amount δL_H and the varying amount δH_L of the potential VG at the gate of the driving transistor TDR is used to set the compensation initial value VINI, there is an advantage in that the compensation initial value VINI is set to a high potential even in a case where charge accumulated in the additional capacitive element CP is small. Therefore, there is an advantage in that even a low potential of the higher potential VDR_H sufficiently charges the additional capacitive element CP during the reset period TRST as compared with the first embodiment in which the charge in the additional capacitive element CP is used to set the compensation initial value VINI. On the other hand, in the second embodiment, the instruction signal X[n] is required to be increased to the reset potential VRST during the compensation preparing period QA in each selection period Q[m], but, in the first embodiment, the instruction signal X[n] is not required to be increased to the reset potential VRST during the compensation preparing period QA. Thus, according to the first embodiment, there is an advantage in that the number of variations in the potential of the instruction signal X[n] can be reduced as compared with the first embodiment and thus power wasted to the charging and discharging of the signal lines 24 is reduced.

C: Third Embodiment

Figure 17:
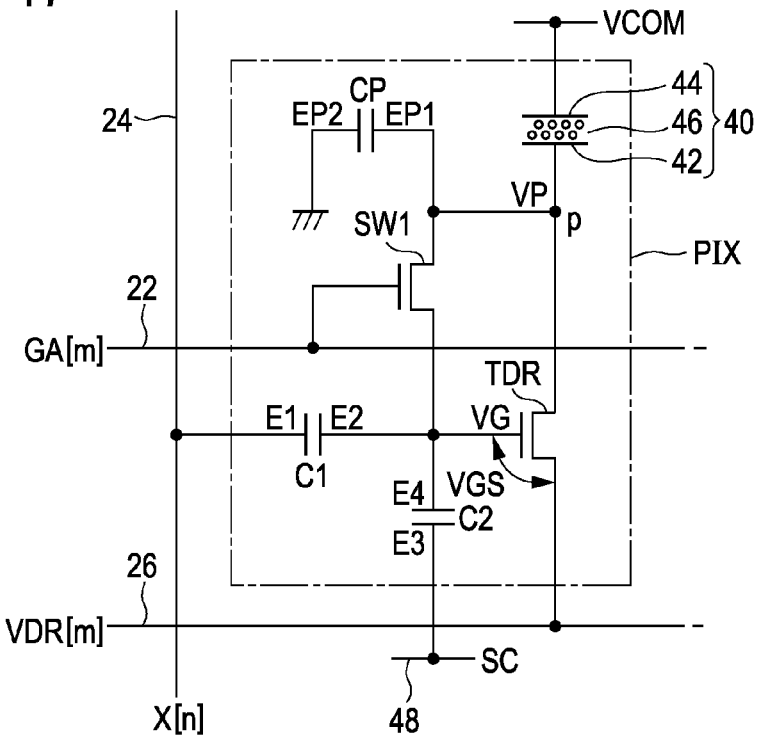
FIG. 17 is a circuit diagram of a pixel circuit according to a third embodiment.

FIG. 17 is a circuit diagram of a pixel circuit PIX according to a third embodiment of the invention. As shown in FIG. 17, the pixel circuit PIX according to the third embodiment has a configuration in which a capacitive element C2 is added to the pixel circuit PIX according to the first embodiment. The capacitive element C2 is an electrostatic capacitor including an electrode E3 and an electrode E4. The electrode E3 is connected to a capacitance line 48, and the electrode E4 is connected to the gate of the driving transistor TDR. The capacitance line 48 is a line which is commonly connected to all of the pixel circuits PIX in the display portion 20. The potential control circuit 36 generates a capacitance potential SC which is supplied to the capacitance line 48.

In the first embodiment, the reset operation is performed by setting the instruction signal X[n] to the reset potential VRST during the reset period TRST, and the driving operation is performed by setting the instruction signal X[n] to the variable potential W(t) during the driving period TDRV. In the third embodiment, the reset operation and the driving operation are realized by the use of the capacitance potential SC instead of the instruction signal X[n]. In addition, the method which is the same as in the second embodiment (the method of using the difference between the varying amount δL_H and the varying amount δH_L) of the potential VG is used to set the compensation initial value VINI during the compensation preparing period QA.

Figure 18:
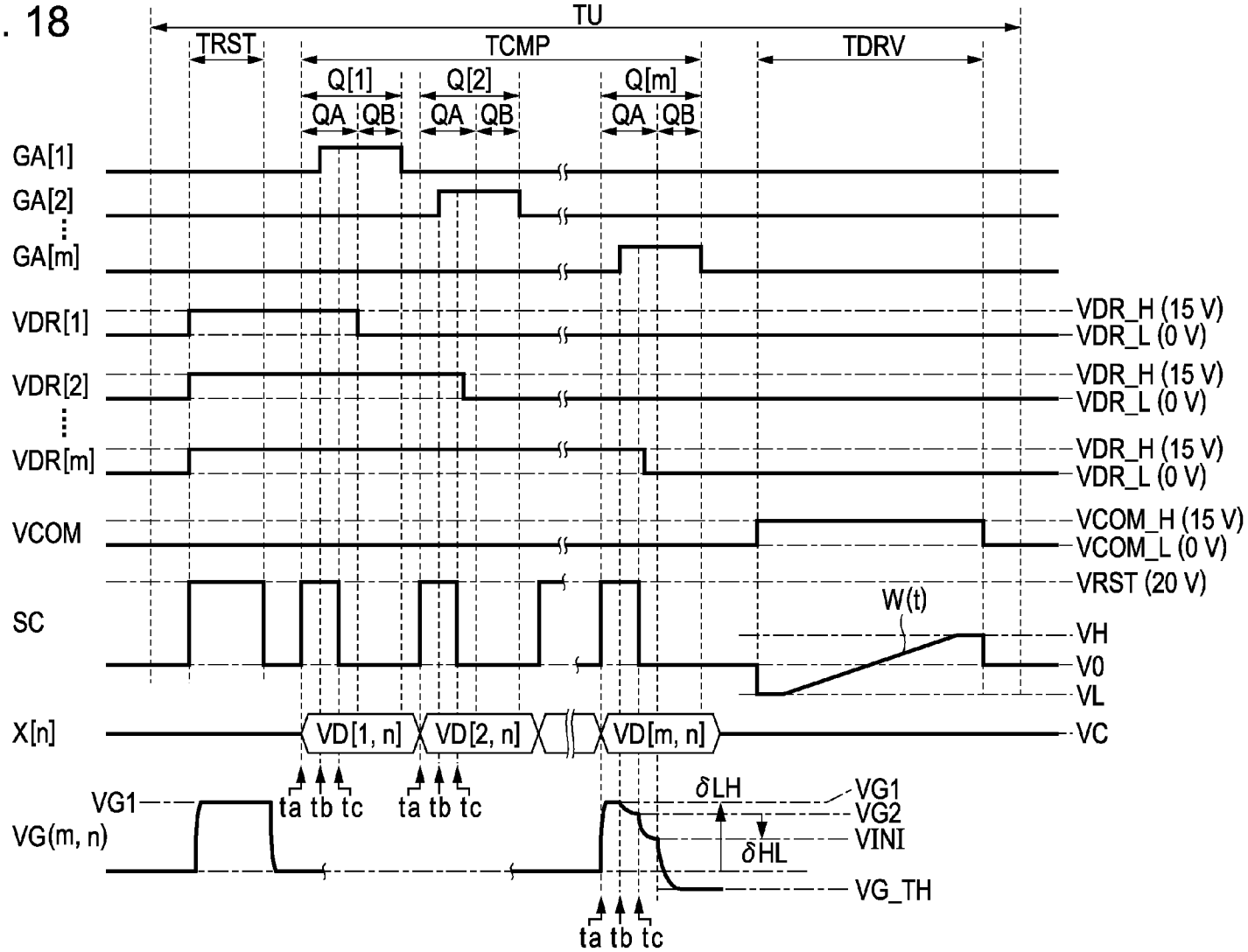
FIG. 18 is a diagram illustrating an operation according to the third embodiment.

FIG. 18 is a diagram illustrating an operation during the unit period TU according to the third embodiment. In the same manner as the first embodiment, the reset operation is performed in parallel in the respective pixel circuits PIX during the reset period TRST, the writing operation and the compensation operation are performed sequentially with row units during the compensation period TCMP, and the driving operation is performed in parallel in the respective pixel circuits PIX during the driving period TDRV.

1. Reset Period TRST

During the reset period TRST, as shown in FIG. 18, the switch SW1 of the respective pixel circuits PIX is maintained to be turned off by setting the control signals GA[1] to GA[m] and the common potential VCOM of the opposite electrode 44 is set to the lower potential VCOM_L. In addition, the column driving circuit 34 maintains the instruction signal X[n] to be the reference potential VC.

In addition, if the reset period TRST starts, the potential control circuit 36 changes the capacitance potential SC for the capacitance line 48 from the potential V0 to the reset potential VRST. The potential V0 is set to the same potential (for example, a ground potential (0 V)) as, for example, the reference potential VC. Since the capacitive element C2 is connected between the capacitance line 48 and the gate of the driving transistor TDR, the potential VG at the gate of the driving transistor TDR is capacitively coupled to the capacitive element C2 and thus is changed from the potential VG0 to the potential VG1 according to the capacitance potential SC. The varying amount δL_H (VG1=VG0+δL_H) of the potential VG according to the capacitance potential SC becomes a voltage (δL_H=β2(VRST−V0), β2=c2/(c1+c2)) obtained by dividing the varying amount (VRST−V0) of the capacitance potential SC using the capacitance value c1 of the capacitive element C1 and the capacitance value c2 of the capacitive element C2.

In the reset period TRST, the row driving circuit 32 sets the driving potential VDR[1] to VDR[m] at the respective driving potential lines 26 to the higher potential VDR_H. The reset potential VRST of the capacitance potential SC is set such that the driving transistor TDR is maintained to be turned on (VGS=VG1−VDR_H>VTH) in a state where the driving potential VDR[m] is set to the higher potential VDR_H (for example, VRST=25 V). As described above, since the driving transistor TDR is controlled to be turned on during the reset period TRST, in the same manner as the first embodiment, the potential VP at the circuit point p is reset to the higher potential VDR_H which is supplied from the driving potential line 26 via the driving transistor TDR (reset operation). Therefore, the reverse bias is applied to the electrophoresis element 40, and the higher potential VDR_H is maintained at the additional capacitive element CP. If the reset period TRST is finished, the capacitance potential SC is set to the potential V0 immediately before the reset period TRST, and thus the driving transistor TDR is turned off. Thereby, the supply of the higher potential VDR_H to the circuit point p stops.

2. Compensation Period TCMP

During the selection period Q[m] (QA and QB) in the compensation period TCMP, the column driving circuit 34 sets the instruction signal X[n] to the grayscale potential VD[m,n]. The potential control circuit 36 increases the capacitance potential SC to the reset potential VRST at the start point ta of the compensation preparing period QA. Thereby, the potential VG at the gate of the driving transistor TDR is increased to the potential VG1 according to the variation in the capacitance potential SC. At the time point ta, since the switch SW1 is maintained to be turned off and in turn the additional capacitive element CP is electrically insulated from the gate of the driving transistor TDR, in the same manner as the variation during the reset period TRST, the varying amount δL_H of the potential VG at the time point ta becomes a voltage (δL_H=β2(VRST−V0)) obtained by dividing the varying amount (VRST−V0) of the capacitance potential SC using the capacitance value of the capacitive element C1 and the capacitance value of the capacitive element C2.

At the time point tb of the compensation preparing period QA in the selection period Q[m], the row driving circuit 32 changes the control signal GA[m] so as to turn on the switch SW1 of each pixel circuit PIX in the m-th row. Therefore, in the same manner as the second embodiment, the potential VG at the gate of the driving transistor TDR is decreased to the potential VG2 (VG2=VDR_H+VTH) in which the gate-source voltage VGS becomes the threshold voltage VTH.

If the time point tc comes after the time point tb, the potential control circuit 36 decreases the capacitance potential SC from the reset potential VRST to the potential V0. The potential VG at the gate of the driving transistor TDR is decreased from the potential VG2 to the compensation initial value VINI according to the variation in the capacitance potential SC. At the time point tc, since the additional capacitive element CP is connected to the gate of the driving transistor TDR, the varying amount δH_L (VINI=VG2−δH_L) of the potential VG at the time point tc becomes a voltage (δH_L=γ2(VRST−V0), γ2=c2/(c1+c2+cP)) obtained by dividing the varying amount (VRST−V0) of the capacitance potential SC using the capacitances of the respective capacitive element C1, the capacitive element C2, and the additional capacitive element CP. In other words, the varying amount δH_L of the potential VG at the time point tc is lower than the varying amount δL_H of the potential VG at the time point ta. By the use of the difference between the δH_L and δL_H described above, the compensation initial value VINI is set to a potential higher than the potential VG0 at the gate before the reset period TRST starts, in the same manner as the first embodiment.

During the compensation performing period QB after the compensation preparing period QA in the selection period Q[m] has elapsed, if the driving potential VDR[m] is changed to the lower potential VDR_L, the compensation operation is performed. In other words, in the same manner as the first and second embodiments, the potential VG at the gate of the driving transistor TDR is set to a potential VG_TH (VG_TH−VDR_L=VTH) at the end point of the compensation performing period QB, in a state where the grayscale potential VD[m, n] is supplied to the electrode E1 of the capacitive element C1.

3. Driving Period TDRV

During the driving period TDRV, in a state where the instruction signals X[1] to X[n] for the signal lines 24 are maintained to be the reference potential VC and the driving potentials VDR[1] to VDR[m] for the driving potential lines 26 are maintained to be the lower potential VDR_L, the potential control circuit 36 sets the capacitance potential SC to the potential W(t). The potential W(t) is changed from the potential VL to the potential VH with the passage of time from the start point of the driving period TDRV to the end point thereof in the same manner as the first embodiment. Since the capacitive element C2 is connected between the capacitance line 48 and the gate of the driving transistor TDR, the potential VG at the gate of the driving transistor TDR of each pixel circuit PIX is capacitively coupled to the capacitive element C2 and thus is changed depending on the potential W(t). Therefore, in the same manner as the first embodiment, the driving transistor TDR is changed from the turned-off state to the turned-on state and the forward bias starts being applied to the electrophoresis element 40 at the time point corresponding to the grayscale potential VD[m,n] during the driving period TDRV. In addition, although only the capacitive element C1 is accompanied by the gate of the driving transistor TDR in the first embodiment, since in this embodiment, the capacitive element C1 and the capacitive element C2 are accompanied by the gate of the driving transistor TDR, in order to change the potential VG in this embodiment in the same range as in the first embodiment, the potential W(t) of the capacitance potential SC is required to be changed with an amplitude larger than the potential W(t) in the first embodiment.

The above-described third embodiment also achieves the same effect as the first embodiment. In addition, in the third embodiment, since the capacitance potential SC is used in the reset operation and the driving operation, an operation for changing the instruction signal X[n] to the reset potential VRST during the reset period TRST and an operation for changing the instruction signal X[n] from the potential VL to the potential VH during the driving period TDRV are not performed. In other words, according to the third embodiment, the amplitude of the instruction signal X[n] is reduced as compared with in the first embodiment, and thus there is an advantage in that the voltage resistance performance necessary for the column driving circuit 34 is lowered. On the other hand, since only the capacitive element C1 is accompanied by the gate of the driving transistor TDR in the first embodiment, there is an advantage in that the charging and the discharging when the potential VG at the gate of the driving transistor TDR is changed is reduced (and in turn power consumption is reduced) as compared with the third embodiment in which the capacitive element C1 and the capacitive element C2 are accompanied by the driving transistor TDR.

D: Fourth Embodiment

In order to change the driving transistor TDR from the turned-off state to the turned-on state during the driving period TDRV, it is necessary to change the gate-source voltage VGS of the driving transistor TDR with the passage of time. As methods for changing the voltage VGS, there are a method for changing the potential VG at the gate and a method for changing the potential at the source. The first embodiment in which the instruction signal X[n] is set to the potential W(t) or the third embodiment in which the capacitance potential SC is set to the potential W(t) is a detailed example of the former method for changing the potential VG at the gate of the driving transistor TDR. On the other hand, the fourth embodiment described below employs the latter method for changing the potential at the source of the driving transistor TDR (that is, the driving potential VDR[m]) during the driving period TDRV with the passage of time. The configuration of the pixel circuit PIX is the same as in the first embodiment.

Figure 19:
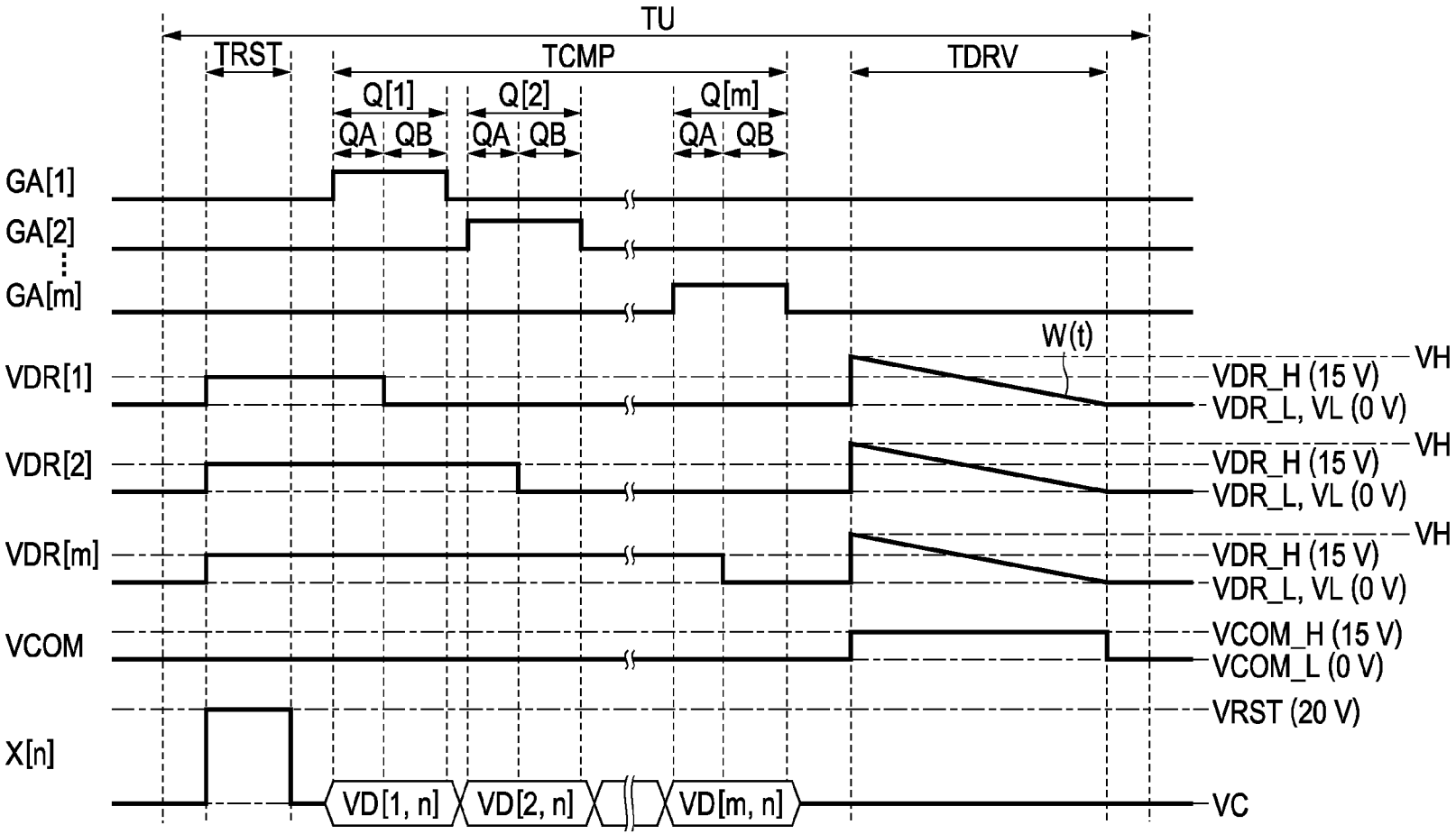
FIG. 19 is a diagram illustrating an operation according to a fourth embodiment.

FIG. 19 is a diagram illustrating an operation during the unit period TU according to the fourth embodiment. The operations during the reset period TRST and the compensation period TCMP are the same as in the first embodiment, and thus the description thereof will be omitted, and an operation during the driving period TDRV will be described below.

The column driving circuit 34 maintains the instruction signals X[1] to X[n] to be reference potential VC during the driving period TDRV. Therefore, the potential VG at the gate of the driving transistor TDR is fixed during the driving period TDRV. On the other hand, the row driving circuit 32 sets the driving potentials VDR[1] to VDR[m] supplied to the respective driving potential lines 26 (the sources of the driving transistors TDR of the respective pixel circuits PIX) to the potential W(t). As shown in FIG. 19, the potential W(t) is decreased from the potential VH to the potential VL (VL=VDR_L=0V) with the passage of time from the start point of the driving period TDRV to the end point thereof. Therefore, the gate-source voltage VGS of the driving transistor TDR is increased with the passage of time during the driving period TDRV in the same manner as the first to third embodiments. In addition, the driving transistor TDR is turned on at the time point when the voltage VGS of each driving transistor TDR reaches the threshold voltage VTH thereof, and the driving potential VDR[m] (potential W(t)) is supplied to the electrophoresis element 40.

Figure 20A:
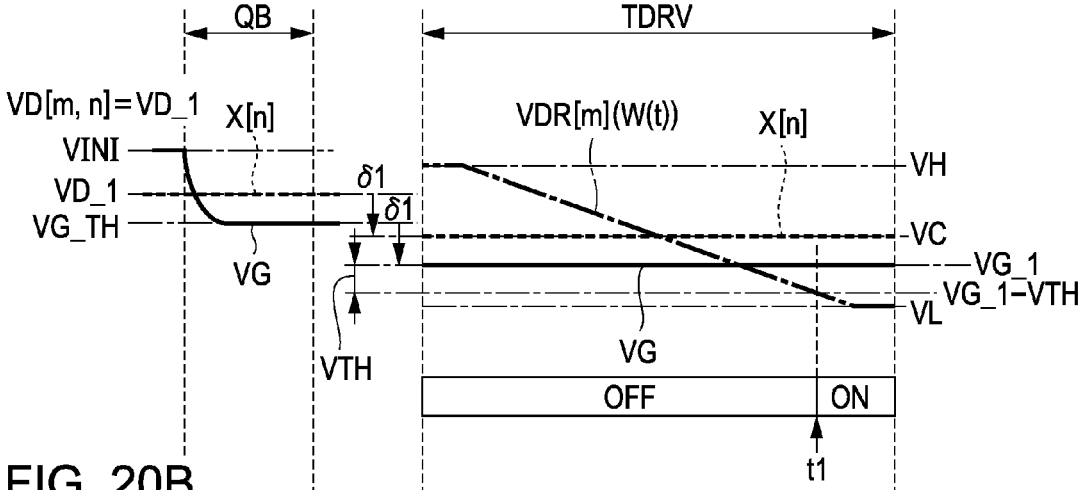
FIGS. 20A and 20B are diagrams illustrating a relationship between an operation point and a grayscale potential in the driving transistor according to the fourth embodiment.
Figure 20B:
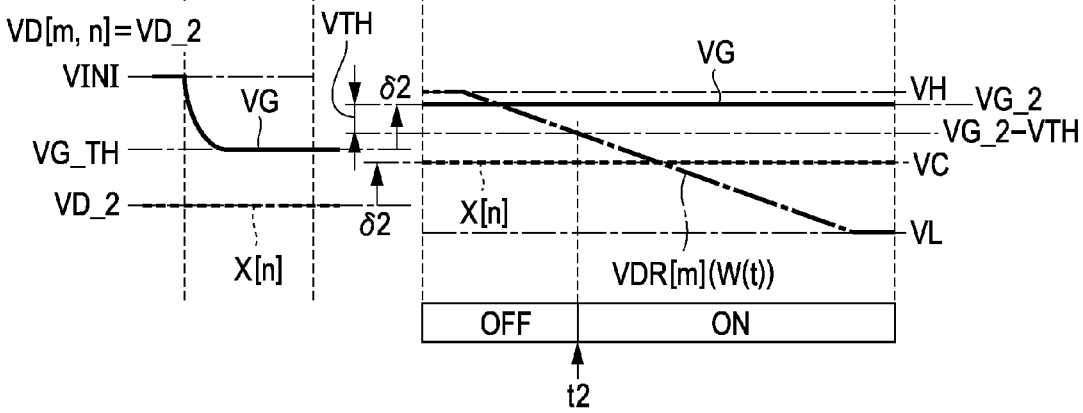

FIGS. 20A and 20B are schematic diagrams illustrating examples of variations with the passage of time in the potential (broken lines) of the instruction signal X[n], the potential VG (solid lines) at the gate of the driving transistor TDR, and the driving potential VDR[m] (chained lines). FIG. 20A shows a case where the grayscale potential VD[m,n] is set to the potential VD_1 (VD_1>VC). If the instruction signal X[n] is set to the reference potential VC at the start point of the driving period TDRV, the potential VG at the gate of the driving transistor TDR is changed to the potential VG_1 which is lower than the potential VG_TH after the setting during the compensation period TCMP by the difference 81 between the grayscale potential VD_1 and the reference potential VC. At the time point t1 when the potential W(t) of the driving potential VDR[m] is decreased with the passage of time and reaches the potential (VG_1−VTH) which is lower than the potential VG_1 by the threshold voltage VTH, the gate-source voltage VGS of the driving transistor TDR becomes the threshold voltage VTH and then the driving transistor TDR is turned on.

In addition, FIG. 20B shows a case where the grayscale potential VD[m,n] is set to the potential VD_2 (VD_2<VC) lower than the potential VD_1. When the driving period TDRV starts, the potential VG at the gate of the driving transistor TDR is changed to the potential VG_2 higher than the potential VG_TH which has been set during the compensation period TCMP by the difference 82 between the grayscale potential VD_2 and the reference potential VC. In addition, the driving transistor TDR is turned on at the time point t2 when the potential W(t) of the driving potential VDR[m] is decreased to the potential (VG_2−VTH) lower than the potential VG_2 by the threshold voltage VTH.

As described above, the time points t1 and t2 when the driving transistor TDR is changed from the turned-off state to the turned-on state are controlled to be varied depending on the grayscale potential VD[m,n] during the driving period TDRV. Therefore, in the same manner as the above-described embodiments, the grayscale for the electrophoresis element 40 of each pixel circuit PIX is controlled in multiple steps according to the grayscale potential VD[m,n] for corresponding pixel circuit PIX. Specifically, as can be seen from the examples in FIGS. 20A and 20B, since the lower the grayscale potential VD[m,n] is, the longer the driving transistor TDR is turned on, the grayscale for the electrophoresis element 40 is controlled to be a low grayscale (grayscale close to black). The fourth embodiment also achieves the same effect as the first embodiment.

E: Fifth Embodiment

In the above-described embodiments, the forward bias (a voltage with the positive polarity) is applied to the electrophoresis element 40 during the driving period TDRV, and the reverse bias (a voltage with the negative polarity) is applied to the electrophoresis element 40 during the reset period TRST. Therefore, upon comparison with the configuration in which the reverse bias is not applied during the unit period TU (for example, a configuration in which the common potential VCOM is maintained to be the higher potential VCOM_H during the reset period TRST), it is possible to suppress the DC component from being applied to the electrophoresis element 40. However, since a time for applying the forward bias and a time for applying the reverse bias (the reset period TRST) are different from each other, it is difficult to completely prevent the DC component from being applied to the electrophoresis element 40. Therefore, in the fifth embodiment, the application of the DC component is prevented by appropriately selecting the grayscale potential VD[m,n] over a plurality of unit periods TU in a case where displayed images are changed.

Figure 21:
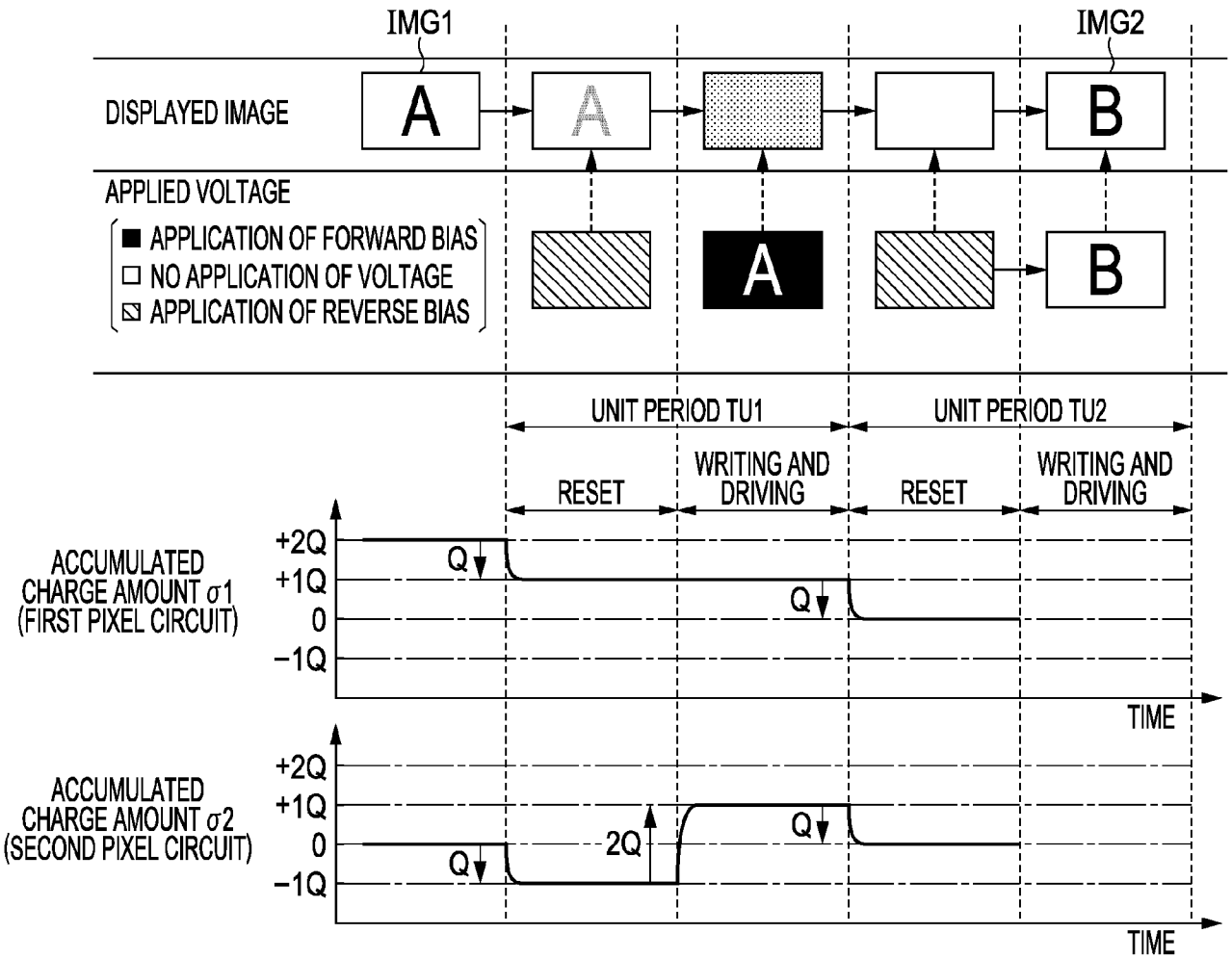
FIG. 21 is a diagram illustrating an operation according to a fifth embodiment.

FIG. 21 is a diagram illustrating an operation of the electro-optical device 100 according to the fifth embodiment. As shown in FIG. 21, it is assumed that a displayed image on the display portion 20 is changed from an image IMG1 to an image IMG2. The image IMG1 is a still image in which a black character "A" is disposed on a white background, and the image IMG2 is a still image in which a black character "B" is disposed on a white background. The image IMG1 is changed to the image IMG2 through the unit period TU1 and the unit period TU2 from a state where the image IMG1 is displayed.

FIG. 21 shows a temporal transition of a charge amount (hereinafter, referred to as an "accumulated charge amount") σ accumulated in the electrophoresis element 40 of each pixel circuit PIX. The accumulated charge amount σ1 in FIG. 21 indicates a charge amount accumulated in the electrophoresis element 40 of each of the pixel circuits (hereinafter, referred to a "first pixel circuit") PIX corresponding to black pixels constituting the character "A" of the image IMG1 among a plurality of pixel circuits PIX in the display portion 20. On the other hand, the accumulated charge amount σ2 indicates a charge amount accumulated in the electrophoresis element 40 of each of the pixel circuits (hereinafter, referred to a "second pixel circuit") PIX corresponding to white pixels constituting the background of the image IMG1 among a plurality of pixel circuits PIX in the display portion 20. As the accumulated charge amount σ (σ1 and σ2) is increased to the positive polarity side, the display grayscale for the electrophoresis element 40 is moved to the black side.

FIG. 21 schematically shows voltages applied to the electrophoresis element 40 of each pixel circuit PIX. During the driving period TDRV, the forward bias is applied to the electrophoresis elements 40 of the pixel circuits PIX designated to be black, and a voltage is not applied to the electrophoresis elements 40 of the pixel circuits PIX designated to be white (that is, the driving transistor TDR is not turned on). On the other hand, during the reset period TRST, the reverse bias is collectively applied to the electrophoresis elements 40 of all the pixel circuits PIX. If the forward bias is supplied, charge corresponding to +2Q is supplied to the electrophoresis element 40 and the display grayscale is moved to the black side, and if the reverse bias is applied, charge corresponding to Q is removed from the electrophoresis element 40 and the display grayscale is moved to the white side. When a voltage is not applied (no application of a voltage), movement of charge (variation in the accumulated charge amount σ) does not occur. As shown in FIG. 21, in the state where the image IMG1 is displayed (before the unit period TU1 starts), the accumulated charge amount σ1 in the electrophoresis element 40 of the first pixel circuit PIX (black) is +2Q, and the accumulated charge amount σ2 in the electrophoresis element 40 of the second pixel circuit PIX (white) is zero.

In the reset operation during the unit period TU1, the reverse bias is applied to the electrophoresis elements 40 of all of the pixel circuits PIX. As shown in FIG. 21, when the reverse bias is applied, the accumulated charge amount σ1 in the first pixel circuits PIX is changed to +1Q from +2Q through decrease by Q. Therefore, the grayscale for the electrophoresis element 40 of each of the first pixel circuits PIX becomes the intermediate grayscale (gray) through transition to the white side from the black by a degree of decrease in the charge amount Q. On the other hand, when the reverse bias is applied, the accumulated charge amount σ2 in the second pixel circuits PIX is changed from zero to −1Q through decrease by Q, but since the grayscale for the electrophoresis element 40 has already reached the white (highest grayscale), the grayscale for the electrophoresis element 40 is hardly changed even if the accumulated charge amount σ2 is decreased (overwritten).

In addition, during the writing operation in the unit period TU1, the control circuit 12 designates the white grayscale for each of the first pixel circuits PIX which have displayed black pixels of the image IMG1 and designates the black grayscale for each of the second pixel circuits PIX which have displayed white pixels of the image IMG1. Therefore, in the driving operation (the driving period TDRV) during the unit period TU1, as shown in FIG. 21, a voltage is not applied to the electrophoresis elements 40 of the first pixel circuits PIX, and the forward bias is applied to the electrophoresis elements 40 of the second pixel circuits PIX. In other words, the accumulated charge amount σ1 in the first pixel circuits PIX is maintained to be +1Q after the reverse bias is applied, and the accumulated charge amount σ2 in the second pixel circuits PIX is changed from −1Q after the reverse bias is applied during the reset period TRST to +1Q through increase by 2Q. As described above, by the application of the reverse bias during the reset period TRST in the unit period TU1 and the voltage application (application of the forward bias and no application) during the driving period TDRV, the accumulated charge amount σ1 in the first pixel circuits PIX and the accumulated charge amount σ2 in the second pixel circuits PIX become the same as each other (σ1=σ2=+1Q). As shown in FIG. 21, the grayscale for the electrophoresis element 40 becomes an intermediate grayscale (gray) corresponding to the charge amount +1Q in both of the first pixel circuits PIX and the second pixel circuits PIX.

In the reset operation (reset period TRST) during the unit period TU2 as well, in the same manner as the unit period TU1, the reverse bias is applied to the electrophoresis elements 40 of all of the pixel circuits PIX, and thus charge corresponding to Q is removed from the electrophoresis element 40 in both of the first pixel circuits PIX and the second pixel circuits PIX. Thus, as shown in FIG. 21, both the accumulated charge amount σ1 and the accumulated charge amount σ2 are changed from +1Q to zero, and the grayscale for all of the electrophoresis elements 40 in the display portion 20 is controlled to be white. In other words, the DC component to the electrophoresis element 40 is not applied to the electrophoresis element 40 in both of the first pixel circuits PIX and the second pixel circuits PIX. In addition, in the writing operation during the unit period TU2, the control circuit 12 designates a grayscale for each pixel of the image IMG2 for each pixel circuit PIX. Thus, the displayed image on the display portion 20 is changed from the image IMG1 to the image IMG2.

According to the fifth embodiment described above, despite the configuration where only the forward bias is applied to the electrophoresis element 40 during the driving period TDRV, and the reverse bias is collectively applied to the electrophoresis elements 40 of all of the pixel circuits PIX during the reset period TRST, it is possible to effectively prevent the DC component from being applied to the electrophoresis element 40. Therefore, there is an advantage in that deterioration in the electrophoresis element 40 caused by the application of the DC component can be effectively prevented.

In addition, in the above description, although in the writing operation during the unit period TU1, each of the first pixel circuits PIX which display black pixels of the image IMG1 is designated to represent the white grayscale, and each of the second pixel circuits PIX which display white pixels of the image IMG1 is designated to represent the black grayscale, the image IMG1 is not limited to binary images of white and black. For example, the above-described embodiment is also applied to a case where the image IMG1 includes intermediate grayscales. Assuming a case where the image IMG1 before being changed includes a first grayscale and a second grayscale (regardless of presence or absence of other grayscales), the writing operation during the unit period TU1 is generalized as an operation in which a grayscale potential VD[m,n] according to the first grayscale is supplied to the respective first pixel circuits PIX which display pixels of the first grayscale of the image IMG1 and a grayscale potential VD[m,n] according to the second grayscale is supplied to the respective second pixel circuits PIX which display pixels of the second grayscale of the image IMG1. As the "grayscale according to the first grayscale" in the above expression, a complementary grayscale of the first grayscale is preferable. In the same manner, as the "grayscale according to the second grayscale", a complementary grayscale of the second grayscale is preferable. The "complementary grayscale" means a grayscale having the same luminance difference from a central value of white and black (that is, an intermediate luminance between the highest luminance and the lowest luminance). For example, assuming four kinds of grayscales, white, light gray, dark gray, and black, the relationship between white and black or the relationship between light gray and dark gray corresponds to the complementary grayscale. According to the above-described configuration, even when the image IMG1 includes the intermediate grayscales, the grayscales for the electrophoresis elements 40 of both of the first pixel circuits PIX and the second pixel circuits PIX can be arranged to have the intermediate grayscale corresponding to the charge amount +1Q.

F: Modified Examples

The above-described embodiments can be variously modified. Detailed aspects of modifications will be exemplified below. Two or more aspects which are arbitrarily selected from the following examples may be appropriately combined.

1. Modified Example 1

In the respective embodiments, although the configuration (hereinafter, referred to as "configuration A") where the driving transistor TDR is changed from the turned-off state to the turned-on state at a time point corresponding to a designated grayscale during the driving period TDRV has been exemplified, a configuration (hereinafter, referred to as "configuration B") where the driving transistor TDR is changed from the turned-on state to the turned-off state at the time point corresponding to the designated grayscale during the driving period TDRV may be employed. However, configuration A employed in the respective embodiments described above is advantageous in that a time from the starting of the driving period TDRV until a user actually recognizes the content of a displayed image can be reduced as compared with configuration B, as described below in detail.

Figure 22A:
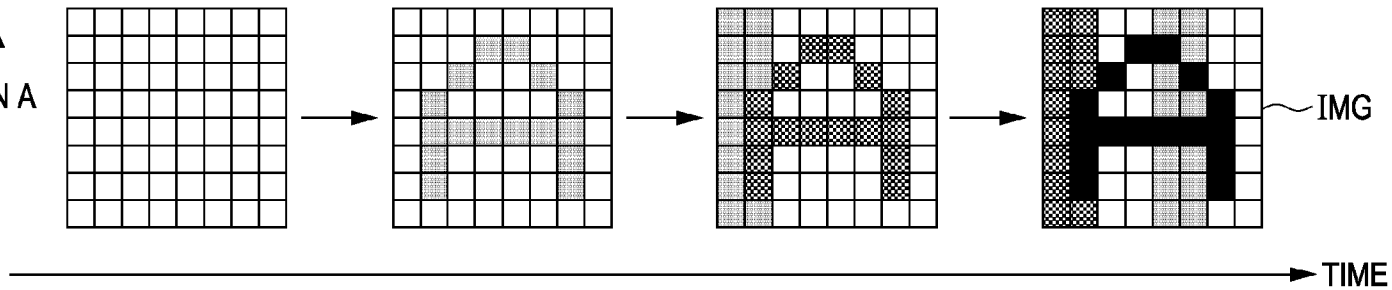
FIGS. 22A and 22B are diagrams illustrating a relationship between driving of the driving transistor and visibility of a displayed image.
Figure 22B:
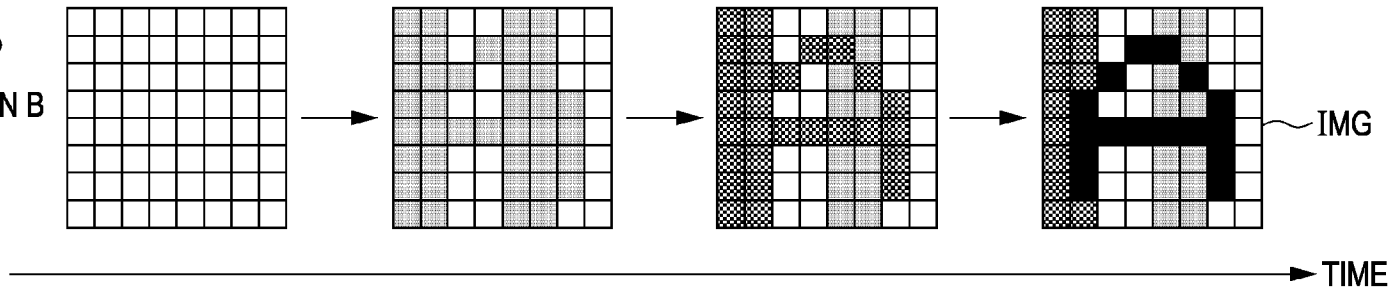

FIGS. 22A and 22B are schematic diagrams illustrating a displayed image on the display portion 20, which is varied with the passage of time from the start point of the driving period TDRV to the end point thereof. FIG. 22A corresponds to configuration A and FIG. 22B corresponds to configuration B. FIGS. 22A and 22B show a case where an image IMG including four kinds of grayscales (white, black, and two kinds of intermediate grayscales) is displayed. The image IMG is an image in which a black character "A" is disposed on a background constituted by the white and the intermediate grayscales.

As shown in FIG. 22B, in configuration B, if the driving transistors TDR of the respective pixel circuits PIX to which the grayscales (black and intermediate grayscales) other than the white are designated are simultaneously changed to the turned-on state at the time point of the driving period TDRV, the grayscales for the electrophoresis elements 40 start being moved to the black side, and if the driving transistor TDR is changed from the turned-on state to the turned-off state at a time point corresponding to a grayscale designated to each pixel circuit PIX during the driving period TDRV, the variation in the grayscale for the electrophoresis element 40 stops. Therefore, the black character "A" of the image IMG is initially recognized by a user immediately before the end point of the driving period TDRV.

On the other hand, as shown in FIG. 22A, in configuration A, if the driving transistor TDR of each pixel circuit PIX is set to the turned-off state at the time point of the driving period TDRV and is changed from the turned-off state to the turned-on state at a time point corresponding to a grayscale designated to each pixel circuit PIX, a grayscale for the electrophoresis element 40 starts being moved to the black side. In other words, as a grayscale designated to each pixel circuit PIX is closer to the black, a grayscale for the electrophoresis element 40 starts being moved to the black side from an earlier time point during the driving period TDRV. Thus, the black character "A" is recognized by a user from an earlier time point within the driving period TDRV. In other words, configuration A is advantageous in that a time from the starting of the driving period TDRV until a user actually recognizes the image (particularly, the character) can be reduced as compared with configuration B.

2. Modified Example 2

Figure 23:
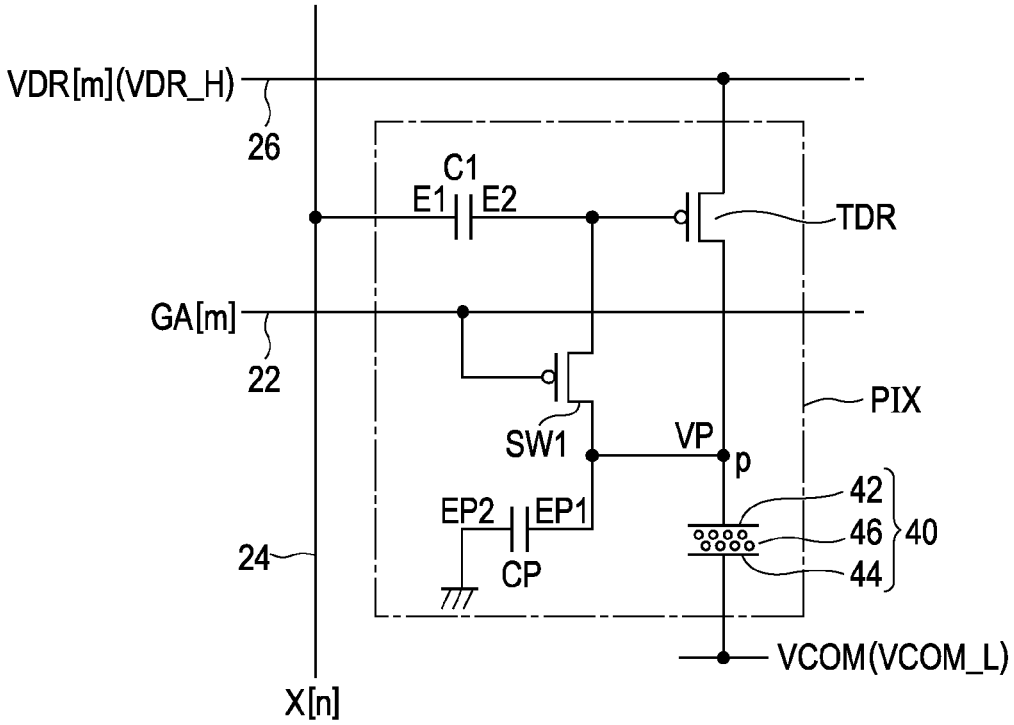
FIG. 23 is a circuit diagram of a pixel circuit according to a modified example.

The conductivity type of each transistor constituting the pixel circuit PIX is arbitrarily changed. For example, a configuration in FIG. 23 may be employed in which the conductivity type of each transistor (TDR and SW1) of the pixel circuit PIX according to the first embodiment (FIG. 2) is changed to the P channel type. In the configuration in FIG. 23, the levels of voltages are reversed as compared with the configuration in FIG. 2. For example, during the driving period TDRV, the common potential VCOM at the opposite electrode 44 is set to the lower potential VCOM_L, and the driving potential VDR[m] (VDR) for the driving potential lines 26 is set to the higher potential VDR_H. However, the fundamental operation is the same as in the respective embodiments, and thus description of an operation in a case of employing the pixel circuit PIX in FIG. 23 will be omitted. In addition, a pixel circuit PIX in which transistors having different conductivity types are mixed may be employed, but, from the viewpoint of simplicity of manufacturing steps of the pixel circuit PIX, the conductivity types of the respective transistors in the pixel circuit PIX are particularly preferably identical in the same manner as the above-described embodiments.

In addition, a material, a structure, or a manufacturing method of each transistor (TDR and SW1) of the pixel circuit PIX is arbitrary. For example, a material of a semiconductor layer of each transistor may use, for example, an amorphous semiconductor (for example, an amorphous silicon), an oxide semiconductor, an organic semiconductor, a polycrystalline semiconductor (for example, a high-temperature poly-silicon or a low-temperature poly-silicon).

3. Modified Example 3

In the above-described embodiments, as a configuration for setting the potential VG at the gate of the driving transistor TDR to the compensation initial value VINI during the compensation preparing period QA, the configurations (the first and fourth embodiments) using the movement of charge accumulated in the additional capacitive element CP during the reset period TRST and the configurations (the second and third embodiments) using the difference between the increasing amount δL_H and the decreasing amount δH_L of the potential VG have been exemplified. As a configuration for increasing the potential VG at the gate of the driving transistor TDR during the reset period TRST, the configurations (the first, second, and fourth embodiments) using the instruction signal X[n] and the configuration (the third embodiment) using the capacitance potential SC have been exemplified. In addition, as a configuration for varying the gate-source voltage VGS of the driving transistor TDR with the passage of time during the driving period TDRV, the configurations (the first and second embodiments) of setting the instruction signal X[n] to the potential W(t), the configuration (the third embodiment) of setting the capacitance potential SC to the potential W(t), and the configuration (the fourth embodiment) of setting the driving potential VDR to the potential W(t) have been exemplified. The combination of the above-described respective elements (the configuration for setting the compensation initial value VINI, the configuration for increasing the potential VG during the reset period TRST, and the configuration for varying the voltage VGS) is arbitrary, and thus may be appropriately modified without being limited to the examples of the above-described respective embodiments.

4. Modified Example 4

In the first to fourth embodiments, although the instruction signal X[n] is set to the grayscale potential VD[m,n] before the compensation performing period QB starts, a time point for starting the writing operation is appropriately changed. For example, a configuration may be employed in which the instruction signal X[n] is set to the grayscale potential VD[m, n] after the end point of the compensation preparing period QA. However, a configuration is preferable in which a potential at the electrode E1 of the capacitive element C1 is set to the grayscale potential VD[m,n] at the end point of the compensation performing period QB when the potential VG at the gate of the driving transistor TDR is set to the potential VG_TH corresponding to the threshold voltage VTH.

5. Modified Example 5

Although in the respective embodiments, the potential W(t) is controlled to the ramp waveform (In other words, a waveform which monotonically increases or monotonically decreases in a linear manner), a waveform of the potential W(t) is arbitrary. For example, although the potential W(t) is varied linearly in the above-described embodiments, the potential W(t) may be varied in a curved manner. In addition, in the above-described embodiments, although the potential W(t) monotonically increases (monotonically decreases in the fourth embodiment) during the driving period TDRV, the potential W(t) may be increased and decreased during the driving period TDRV. Specifically, a triangular wave in which a potential is linearly increased from the start point of the driving period TDRV and is linearly decreased in the course thereof or a sinusoidal wave in which a potential is varied in a curved manner during the driving period TDRV may be used as the potential W(t).

6. Modified Example 6

Relationships between voltages applied to the electrophoresis element 40 and the grayscales are not limited to the above-described embodiments. For example, in the case of the electrophoresis element 40 using the white charged particles 462W with the negative polarity and the black charged particles 462B with the positive polarity in contrast to the embodiment shown in FIG. 3, a display grayscale for the electrophoresis element 40 is moved to the white side when the forward bias is applied during the driving period TDRV, and is moved to the black side when the reverse bias is applied during the reset period TRST. In addition, the positions (the observing side/the rear surface side) of the pixel electrode 42 and the opposite electrode 44 are changed. For example, in the embodiment shown in FIG. 3, if the opposite electrode 44 is disposed on the rear surface side and the pixel electrode 42 is disposed on the front surface side, a configuration is implemented in which a display grayscale for the electrophoresis element 40 is moved to the white side when the forward bias is applied.

The configuration of the electrophoresis element 40 is appropriately changed. For example, a configuration in which the white charged particles 462W are dispersed in the black dispersion medium 464 or the black charged particles 462B are dispersed in the white dispersion medium 464 may be employed (one-particle system). In addition, colors of the charged particles 462 or the dispersion media 464 constituting the electrophoresis element 40 are arbitrarily changed. The electrophoresis element 40 may be employed in which three kinds or more of particles (for example, one kind is not charged) corresponding to different display colors are dispersed.

However, a target to be driven by the pixel circuit PIX in the above-described respective embodiments is not limited to the electrophoresis element 40. For example, the invention is applicable to driving arbitrary electro-optical elements such as a liquid crystal element, a light emitting element (for example, an organic EL element or an LED (Light Emitting Diode)), a field emission (FE) element, a surface conduction electron emitter (SE) element, a ballistic electron emitting (BS) element, and a non-emissive element. That is to say, the electro-optical element is generalized as a driven element which converts one of an electrical operation (an application of a voltage or a supply of a current) and an optical operation (variation in a grayscale or light emission) into the other. However, from the viewpoint of achieving the above-described object of effectively compensating errors in characteristics of the driving transistor TDR, it is particularly preferable that the invention is applied to a case of driving a high resistance electro-optical element such as the electrophoresis element 40 or the liquid crystal element.

G: Applications

Figure 24:
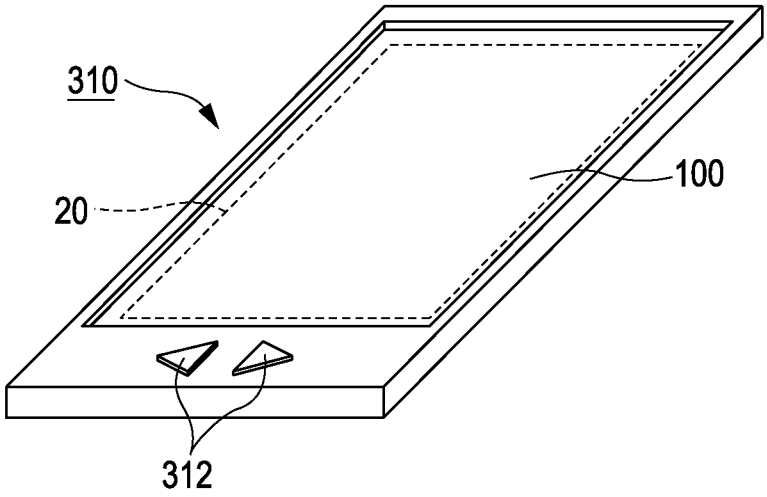
FIG. 24 is a perspective view of an electronic apparatus (information terminal).
Figure 25:
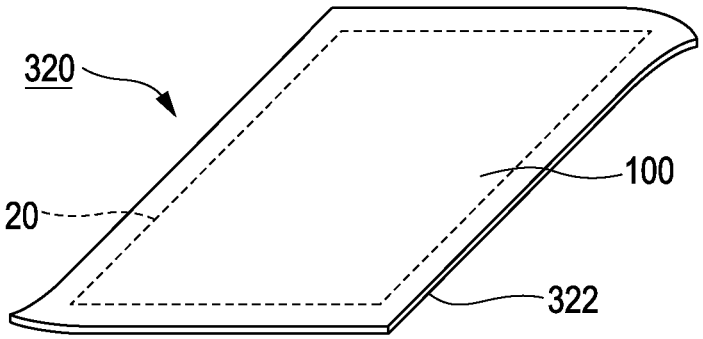
FIG. 25 is a perspective view of an electronic apparatus (electronic paper).
Figure 26:
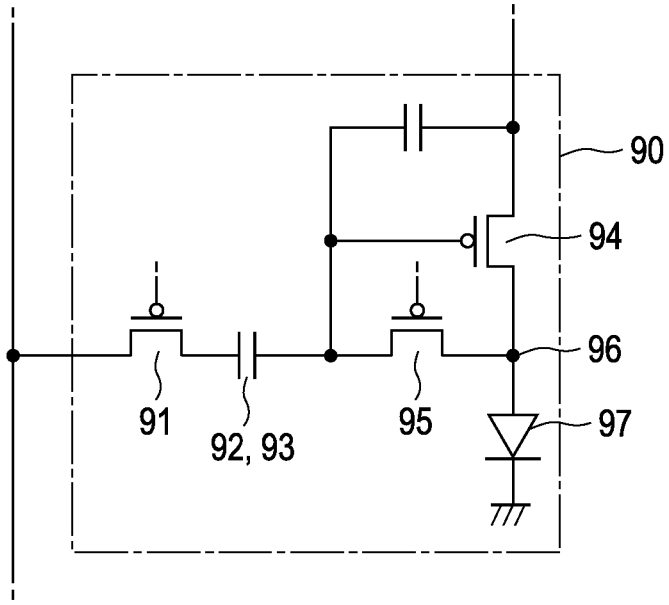
FIG. 26 is a circuit diagram of a pixel circuit disclosed in JP-A-2009-48202.

An electronic apparatus to which the invention is applied will be exemplified. FIGS. 24 and 25 show an exterior of an electronic apparatus which uses the electro-optical device 100 according to each embodiment described above as a display device.

FIG. 24 is a perspective view of a portable information terminal (electronic book) 310 using the electro-optical device 100. As shown in FIG. 24, the information terminal 310 includes an operation portion 312 which is operated by a user and the electro-optical device 100 which displays images on the display portion 20. If the operation portion 312 is operated, display images on the display portion 20 are changed. FIG. 25 is a perspective view of an electronic paper 320 using the electro-optical device 100. As shown in FIG. 25, the electronic paper 320 includes the electro-optical device 100 formed on a surface of a flexible board (sheet) 322.

An electronic apparatus to which the invention is applied is not limited to the above-described examples. For example, the electro-optical device of the invention is applicable to various kinds of electronic apparatuses such as a portable phone, a timepiece (wristwatch), a portable audio reproduction device, an electronic diary, and a touch panel mounting display device.

What is claimed is:

1. An electro-optical device comprising:

a pixel circuit; and a driving circuit, wherein the pixel circuit includes:

a driving transistor that has a first terminal connected to a driving potential line to which a driving potential is supplied, a second terminal connected to a circuit point, and a control terminal controlling a connection state between both the first and second terminals;

a first capacitive element that has a first electrode connected to a signal line and a second electrode connected to the control terminal;

an electro-optical element that is connected to the circuit point; and a switch that controls a connection between the circuit point and the control terminal, wherein the driving circuit:

controls the switch to be turned off, and varies a potential at the control terminal such that the driving transistor is turned on, during a first period when the driving potential is set to a first potential;

sets the potential at the control terminal to a compensation initial value by controlling the switch to be turned on, during a second period after the first period has elapsed;

supplies a grayscale potential corresponding to a designated grayscale from the signal line to the first electrode and varies the driving potential from the first potential to a second potential such that the driving transistor is turned on, during a third period after the second period has elapsed; and varies a voltage between the control terminal and the first terminal with the passage of time, during a fourth period after the third period has elapsed.

2. The electro-optical device according to claim 1, wherein the driving circuit varies the potential at the control terminal so as to be reverse to the variation during the first period before the second period starts, and sets the potential at the control terminal to the compensation initial value by controlling the switch to be turned on during the second period.

3. The electro-optical device according to claim 1, wherein the driving circuit controls the switch to be turned on and then sets the potential at the control terminal to the compensation initial value by varying the potential at the control terminal so as to be reverse to the variation during the first period, during the second period.

4. The electro-optical device according to claim 1, wherein the driving circuit varies the potential at the control terminal with the passage of time due to a capacitive coupling with the first capacitive element by varying a potential at the first electrode during the fourth period.

5. The electro-optical device according to claim 1, wherein the pixel circuit further includes a second capacitive element that has a third electrode connected to a capacitance line to which a capacitance potential is supplied and a fourth electrode connected to the control terminal, and wherein the driving circuit varies the potential at the control terminal with the passage of time due to a capacitive coupling with the second capacitive element by varying the capacitance potential during the fourth period.

6. The electro-optical device according to claim 5, wherein the driving circuit varies the potential at the control terminal due to a capacitive coupling with the second capacitive element by varying the capacitance potential during the first period.

7. The electro-optical device according to claim 1, wherein the driving circuit varies a voltage between the control terminal and the first terminal with the passage of time by varying the driving potential for the driving potential line during the fourth period.

8. The electro-optical device according to claim 1, wherein the driving circuit varies the potential at the control terminal due to a capacitive coupling with the first capacitive element by varying a potential at the first electrode during the first period.

9. The electro-optical device according to claim 1, wherein the driving circuit varies a voltage between the control terminal and the first terminal with the passage of time such that the driving transistor is changed from a turned-off state to a turned-on state at a time point corresponding to a designated grayscale within the fourth period.

10. The electro-optical device according to claim 1, wherein the driving circuit varies a voltage between the control terminal and the first terminal with the passage of time such that the driving transistor is changed from a turned-on state to a turned-off state at a time point corresponding to a designated grayscale within the fourth period.

11. The electro-optical device according to claim 1, wherein the driving circuit applies a voltage with an opposite polarity to the polarity of a case where the driving transistor is turned on during the fourth period, to the electro-optical element during the first period.

12. The electro-optical device according to claim 11, further comprising a display portion in which the pixel circuit is arranged in plurality in a planar shape, wherein a first unit period and a second unit period are set each of which includes the first period, the second period, the third period, and the fourth period, in a case where a display image on the display portion is changed from a first image including a first grayscale and a second grayscale to a second image, and wherein the driving circuit supplies a grayscale potential according to the first grayscale to first pixel circuits corresponding to pixels of the first grayscale in the first image among the plurality of pixel circuits and supplies a grayscale potential according to the second grayscale to second pixel circuits corresponding to pixels of the second grayscale in the first image among the plurality of pixel circuits after the first period in the first unit period has elapsed, and supplies a grayscale potential corresponding to a grayscale for the second image to the respective pixel circuits after the first period in the second unit period has elapsed.

13. An electronic apparatus comprising the electro-optical device according to claim 1.

14. An electronic apparatus comprising the electro-optical device according to claim 2.

15. An electronic apparatus comprising the electro-optical device according to claim 3.

16. An electronic apparatus comprising the electro-optical device according to claim 4.

17. An electronic apparatus comprising the electro-optical device according to claim 5.

18. An electronic apparatus comprising the electro-optical device according to claim 6.

19. A method for driving an electro-optical device which has a pixel circuit including a driving transistor that has a first terminal connected to a driving potential line to which a driving potential is supplied, a second terminal connected to a circuit point, and a control terminal controlling a connection state between both the first and second terminals; a first capacitive element that has a first electrode connected to a signal line and a second electrode connected to the control terminal; an electro-optical element that is connected to the circuit point; and a switch that controls a connection between the circuit point and the control terminal, the method comprising:

controlling the switch to be turned off, and varying a potential at the control terminal such that the driving transistor is turned on, during a first period when the driving potential is set to a first potential;

setting the potential at the control terminal to a compensation initial value by controlling the switch to be turned on, during a second period after the first period has elapsed;

supplying a grayscale potential corresponding to a designated grayscale from the signal line to the first electrode and varying the driving potential from the first potential to a second potential such that the driving transistor is turned on, during a third period after the second period has elapsed; and varying a voltage between the control terminal and the first terminal with the passage of time, during a fourth period after the third period has elapsed.

20. A control circuit used in an electro-optical device which has a pixel circuit including a driving transistor that has a first terminal connected to a driving potential line to which a driving potential is supplied, a second terminal connected to a circuit point, and a control terminal controlling a connection state between both the first and second terminals; a first capacitive element that has a first electrode connected to a signal line and a second electrode connected to the control terminal; an electro-optical element that is connected to the circuit point; and a switch that controls a connection between the circuit point and the control terminal, and a driving circuit driving the pixel circuit, wherein the control circuit controls the driving circuit in order to:

control the switch to be turned off, and vary a potential at the control terminal such that the driving transistor is turned on, during a first period when the driving potential is set to a first potential;

set the potential at the control terminal to a compensation initial value by controlling the switch to be turned on, during a second period after the first period has elapsed;

supply a grayscale potential corresponding to a designated grayscale from the signal line to the first electrode and vary the driving potential from the first potential to a second potential such that the driving transistor is turned on, during a third period after the second period has elapsed; and vary a voltage between the control terminal and the first terminal with the passage of time, during a fourth period after the third period has elapsed.

* * * * *